US006634048B1

(12) United States Patent
Hornung et al.

(10) Patent No.: US 6,634,048 B1
(45) Date of Patent: Oct. 21, 2003

(54) AUTOMATIC TEMPERATURE CONTROL FOR CLOTHES WASHER

(75) Inventors: Richard Edward Hornung, Fisherville, KY (US); David Anthony Schneider, Lexington, KY (US); Dennis Dane Tremblay, Geneva, IL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/340,259

(22) Filed: Jun. 30, 1999

Related U.S. Application Data

(60) Provisional application No. 60/091,266, filed on Jun. 30, 1998.

(51) Int. Cl.[7] ..... D06F 39/08

(52) U.S. Cl. ..... 8/158; 68/12.12; 68/12.03; 68/12.21; 68/12.05; 68/207

(58) Field of Search ..... 68/12.02, 12.01, 68/12.03, 12.12, 12.16, 207, 12.21, 12.05; 8/158

(56) References Cited

U.S. PATENT DOCUMENTS

| | | | |
|---|---|---|---|
| 4,031,911 A | | 6/1977 | Frazar |
| 4,147,297 A | | 4/1979 | Worst |
| 4,267,711 A | | 5/1981 | Kolze |
| 4,322,031 A | | 3/1982 | Gehlert |
| 4,330,081 A | | 5/1982 | McMillan |
| 4,406,401 A | | 9/1983 | Nettro |
| 4,503,575 A | | 3/1985 | Knoop et al. |
| 4,528,709 A | | 7/1985 | Getz et al. |
| 4,643,350 A | | 2/1987 | DeSchaaf et al. |
| 4,711,392 A | * | 12/1987 | Kidouchi et al. |
| 4,941,608 A | * | 7/1990 | Shimizu et al. |
| 4,976,460 A | * | 12/1990 | Newcombe et al. |
| 4,978,058 A | | 12/1990 | Duncan et al. |
| 5,067,333 A | | 11/1991 | Duncan et al. |
| 5,148,976 A | * | 9/1992 | Reid |
| 5,231,722 A | | 8/1993 | Shacklock et al. |
| 5,255,844 A | | 10/1993 | Miller et al. |
| 5,347,610 A | | 9/1994 | Lee |
| 5,439,019 A | | 8/1995 | Quandt et al. |

FOREIGN PATENT DOCUMENTS

| | | |
|---|---|---|
| JP | 62-256112 | * 11/1987 |
| JP | 1-279180 | * 11/1989 |
| JP | 3-171209 | * 7/1991 |
| JP | 7-175532 | * 7/1995 |

* cited by examiner

*Primary Examiner*—Frankie L. Stinson
(74) *Attorney, Agent, or Firm*—George L. Rideout, Jr., Esq.; Armstrong Teasdale LLP

(57) ABSTRACT

An automatic temperature control system which limits the total number of valve cycles for the cold and hot water valves to, for example, a total of ten cycles yet also provides the desired temperature control of water supplied to the wash tub is described. To limit the number of valve cycles, and in one embodiment, the automatic temperature control (ATC) system includes a microprocessor which integrates the temperature of the water provided to the wash tub over time to predict the length of the time period required for the next water valve cycle. The integration balances the energy input on the "OFF" cycle with the energy input during the "ON" cycle. Such balancing limits the number of valve cycles thereby reducing the possibility for premature valve failure and facilitating reduced noise. The ATC control system also provides a pre-treater function. When the pre-treater function is selected, e.g., by depressing a momentary switch mounted on the control panel, and provided that the lid is open, the control system energizes the cold water valve for 7 seconds. As a result, cold water flows into the wash tub. The system provides temperature control yet limits the number of valve cycles during a fill even with extreme water temperatures. Even with such cycle limitations, the control provides the desired temperature control.

16 Claims, 17 Drawing Sheets

AUTOMATIC TEMPERATURE CONTROL FOR CLOTHES WASHER

CROSS REFERENCE TO RELATED APPLICATIONS

This application claims the benefit of U.S. Provisional Application No. 60/091,266 filed Jun. 30, 1998.

FIELD OF THE INVENTION

This invention relates generally to clothes washing machines and more particularly, to control of the temperature of water supplied to the washing machine tub.

BACKGROUND OF THE INVENTION

In at least some known washing machines, water is supplied to the machine from sources of hot and cold water such as household faucets. The washing machine includes conduits which extend from the faucets to a mixing valve, and solenoids control the mixing of water. For example, when the solenoid associated with the hot water conduit is energized, hot water flows to the mixing valve. When the solenoid associated with the cold water conduit is energized, cold water flows to the mixing valve. By selective alternate or concurrent energization of the solenoids, the passage of hot, cold, and warm water from the mixing valve to the tub is controlled.

The known mixing control described above provides acceptable water temperature if the incoming water temperature is within an acceptable range. The range for cold water typically is from 50 to 80° F., and the range for hot water typically is from 120 to 140° F. However, and due to temperature variations and seasonal changes depending upon geographic location, the temperature of the cold water input can drop to near freezing. In this extremely cold temperature, the detergent will not dissolve in the wash water, which can degrade performance and leave detergent residue on the clothes.

One known attempt to overcome problems associated with variations in the cold water temperature includes using an analog electronic control with a temperature sensor to control the water temperature by cycling the water valves during the fill cycle. While such cycling control provides adequate temperature control, the analog control does not limit the number of valve cycles. Unlimited cycling of the valves can cause water hammer (noise) and premature valve failure. For example, and with the known analog control, a water valve can cycle more than 40 times for a large fill with extreme water temperatures.

It would be desirable to provide a water temperature control that limits the number of valve cycles during a fill even with extreme water temperatures. Of course, even with such cycle limitation, the control should still provide the desired temperature control.

SUMMARY OF THE INVENTION

These and other objects may be attained by an automatic temperature control system which limits the total number of valve cycles for the cold and hot water valves to, for example, a total of ten cycles yet also provides the desired temperature control of water supplied to the wash tub. Particularly, and to limit the number of valve cycles, an automatic temperature control board includes a microprocessor which integrates the temperature of the water provided to the wash tub over time to predict the length of the time period required for the next water valve cycle. The integration balances the energy input on the "OFF" cycle with the energy input during the "ON" cycle. Such balancing limits the number of valve cycles thereby reducing the possibility for premature valve failure and facilitating reduced noise.

In one specific embodiment, the automatic temperature control (ATC) function is operator selectable by a toggle switch mounted to the control panel. When the switch is active, the ATC system cycles either the hot and/or cold water valves to control the water temperature in the tub to within the specified range. When the ATC selector switch is deactivated, then the ATC system is disabled and the clothes washer functions in the normal mode.

The ATC control system also includes a pre-treater function. When the pre-treater function is selected, e.g., by depressing a momentary switch mounted on the control panel, and provided that the lid is open, the control system energizes the cold water valve for 7 seconds. As a result, and if COLD or WARM is selected, cold water flows into the wash tub. If HOT is selected, warm water flows into the wash tub.

In an exemplary embodiment, the automatic temperature control system includes a logic board having a microprocessor and a power supply. Generally, the board is configured to provide automatic temperature control (ATC) with the well-known electromechanical control system used in commercially available washing machines. The ATC system also includes a cold control solenoid (COLD) and a hot control solenoid (HOT). These solenoids are coupled to the valves which control the flow of hot and cold water into the washing machine tub. The system further includes a temperature sensor for sensing the temperature of water in the mixer nozzle.

Other inputs to the board include an ATC signal, a PRE-TREATER signal, a C-IN signal, and a H-IN signal. The ATC Signal is a 120 VAC signal that is active when the ATC control is selected on the control panel. When ATC is active, the system operates to regulate the inlet water temperature by controlling the water valves to achieve the desired water temperature in the tub. The PRE-TREATER signal is a 120 VAC signal which indicates whether the system should activate the pre-treater cycle. When the PRE-TREATER signal is active, the system is powered-up and remains active for 7 seconds from the time that the PRE-TREATER signal was received.

The H-IN signal is a 120 VAC signal which indicates that either the hot water or warm water setting has been selected by the operator. Warm water is selected when both the H-IN and C-IN signals are present. The C-IN signal is a 120 VAC signal which indicates that either the cold water or warm water setting has been selected. The H-IN and C-IN signals are supplied to the logic board from the control panel.

The temperature sensor input is supplied from the temperature control thermistor for measuring the temperature of the water in the washing machine mixing nozzle. Particularly, the microprocessor includes an analog-to-digital converter, and the processor reads a signal from the thermistor. The magnitude of the signal is representative of the temperature in the mixing nozzle.

With respect to the outputs from logic board, the HOT water output is a feed through of the H-IN signal to the hot water valve. The COLD water output controls the cold water valve. If the ATC signal is not active, then the C-IN signal feeds through the board to the cold control valve. When the ATC signal is active, then the ATC interrupts the C-IN signal.

Generally, the system controls the temperature of the water in the tub by regulating the inlet water flow between the hot and cold water valves. The ATC board is de-energized until the wash cycle is started and the machine is calling for water. Power is provided through the ATC select signal. On power-up, the system determines if the pre-treater or ATC function is selected. If the ATC function is selected, then the system checks the C-IN signal and the H-IN signal to determine the desired water temperature range. The system then controls the valves so that the desired water temperature is achieved.

The pre-treater function enables the operator to activate the cold water valve for a fixed duration of time while the lid is in the up position. The lid position is sensed by a lid switch which is in an open state with the lid is down and a closed state when the lid is open. When the pre-treater switch is pressed, a first relay is energized to latch on the power to the control for a period of 7 seconds. A second relay is then energized to power the cold water valve for 7 seconds. At the end of the 7 second period, the relays are de-energized to turn off the cold water valve.

To limit the number of valve cycles, the time period during which the ATC function is active is limited by a timer. Particularly, the microprocessor includes a timer, and regardless of the water temperature, the ATC function is not enabled for a timed period. When the timed period expires, the ATC function may be enabled and continue controlling the water temperature.

The microprocessor also includes an accumulator which determines how much heat, or energy, has been added above or below a desired a set point. The microprocessor controls the valve cycling based on the accumulator value, i.e., when the accumulator value is zero then the water temperature is equal to the set point temperature.

By limiting the number of valve cycles and controlling the valve cycling based on the accumulated value above or below the set point, the automatic temperature control system provides temperature control yet limits the number of valve cycles during a fill even with extreme water temperatures. Even with such cycle limitations, and as described below in more detail, the control provides the desired temperature control.

DETAILED DESCRIPTION

Figure 1:
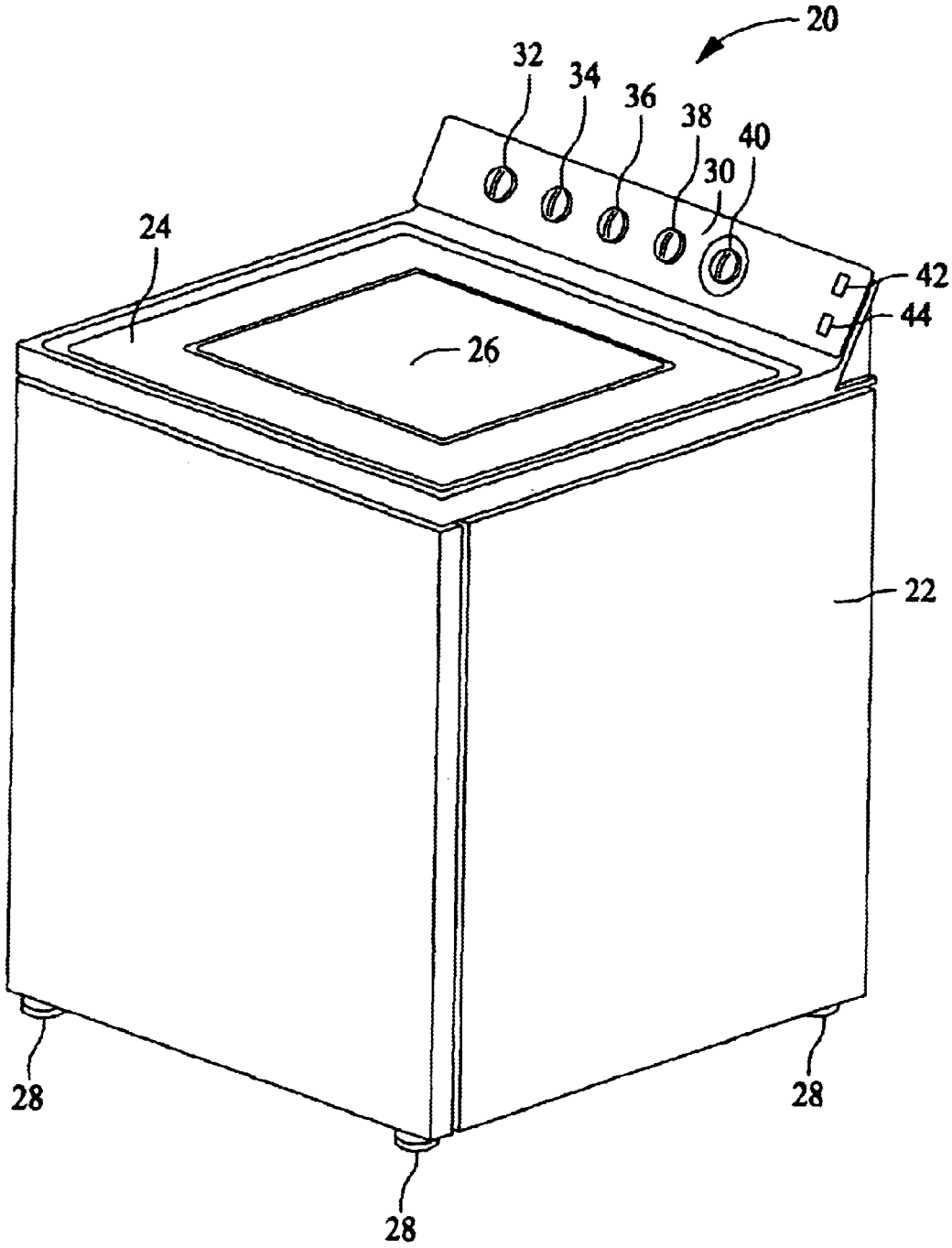
FIG. 1 is a perspective view of a washing machine.

FIG. 1 is a perspective view of an exemplary washing machine 20. Washing machine 20 is shown for illustrative purposes only and not by way of limitation. Washing machine 20 includes a cabinet 22 having a washer cover 24, and a lid 26 is pivotally mounted to washer cover 24. Supports 28 are secured to cabinet. Machine 20 also includes a control panel 30 having washing control knobs 32, 34, 36 and 38 and a timer knob 40. A wash tub is mounted within cabinet 22, and the wash tub is supported by a suspension system. Washing machine 20 may, for example, be a washing machine commercially available from General Electric Company, Appliance Park, Louisville, Ky. 40225.

The automatic temperature control described below in detail could be utilized in connection with many different types of washing machines and is not limited to practice in connection with any one particular washing machine. In one specific embodiment, the automatic temperature control system includes a logic board with a microprocessor, relays, and a thermistor temperature sensor mounted in the water-inlet stream provided to the washing machine tub. Washing machine 20 may be modified to include such system.

Still referring to FIG. 1, the ATC function may be operator selectable by a toggle, push-button, or rotary switch 42 mounted on panel 30. When switch 42 is active, the ATC system will cycle either the hot and/or cold water valves to control the water temperature in the tub to within the specified range. When ATC selector switch 42 is deactivated, then the ATC system is disabled and the clothes washer will function in the normal mode. The ATC control system also may provide a pre-treater function. When selected, e.g., by depressing a momentary switch 44 mounted on control panel 30, and provided that lid 26 is open (as sensed by a lid sensor), the control system energizes the cold water valve for 7 seconds.

When the ATC function is selected, the water temperature in the tub typically should be maintained within the ranges specified in Table 1 for the different wash/rinse settings.

TABLE 1

| Temperature Ranges |
|---|

| WASH/RINSE SETTING | TEMP RANGE WASH | RINSE |
|---|---|---|
| HOT/COLD | 120–130° F. | COLD |
| WARM/WARM | 80–100° F. | 80–100° F. |
| WARM/COLD | 80–100° F. | COLD |
| COLD/COLD | 60–80° F. | COLD |

Figure 2:
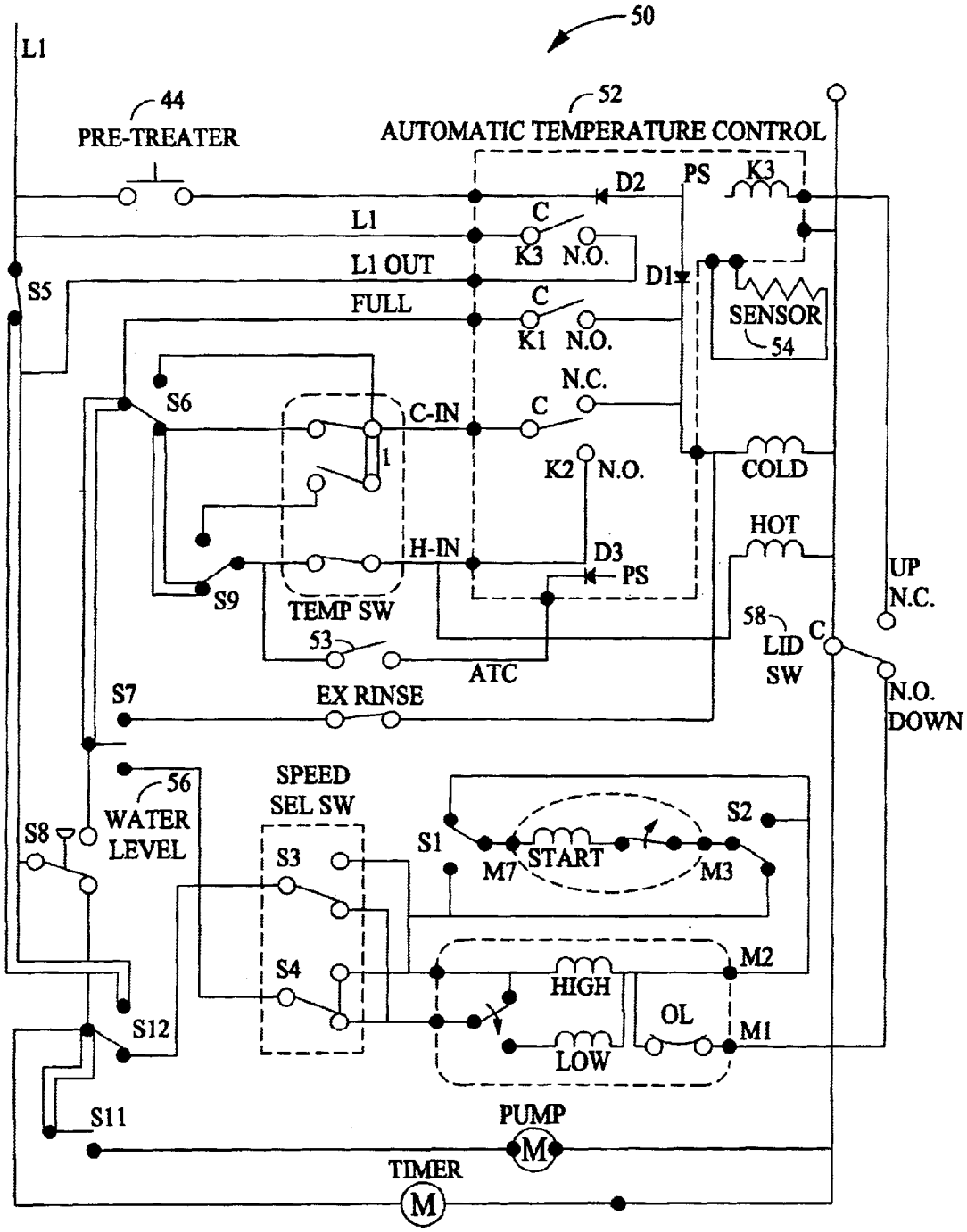
FIG. 2 is a schematic diagram illustration of an automatic temperature control in accordance with one embodiment of the present invention.

The minimum fill is 9 (US) gallons and the maximum fill is 22 (US) gallons. Generally, there should not be more than a total of ten cycles between the two valves (i.e., cold and hot valves) for each fill. Limiting the number of cycles facilitates minimizing the noise and extending the life of the valves. The ATC control system also should satisfy applicable agency standards. Well known standards are UL 244A Solid State Controls for Appliances, and UL560 Electric Home-Laundry Equipment FIG. 2 is a schematic block diagram of an exemplary automatic temperature control system 50 in accordance with one embodiment of the present invention. System 50 includes an automatic temperature control logic board 52. Logic board 52 may, for example, be mounted behind control panel 30 of washer 20. Generally, board 52 is configured to provide an automatic temperature control (ATC) option with the well-known electromechanical control system used in commercially available washing machines. Board 52 may include a microprocessor, microcontroller, and/or logic circuitry to perform the functions described below in more detail. The terms microprocessor, processor and microcontroller as used herein refer to a processor (which may, for example, be a microprocessor, a processor, a microcontroller, an application specific integrated circuit, or logic circuitry) mounted on board 52 and programmed to perform at least some of the ATC functions as described below in more detail.

System 50 also includes a cold control solenoid (COLD) and a hot control solenoid (HOT). These solenoids are coupled to the valves which control the flow of hot and cold water into the washing machine tub. Generally, water flows through the valves and through a mixer nozzle before flowing into the tub. More particularly, washing machines typically include conduits adapted to be connected to sources of hot and cold water, such as household faucets. The respective conduits extend into a mixing valve having solenoids. Selecting alternative or concurrent energization of the solenoids opens and closes the water inlets into the mixing valve to provide the passage of hot, cold, and warm water from the mixing valve to the mixer nozzle. The water flows through the mixer nozzle to the tub. The water valves typically operate at 120 VAC 60 Hz at 10 watts pilot duty. Further details regarding the valves and mixer are set forth, for example, in U.S. Pat. No. 4,031,911, which is assigned to the present assignee.

System 50 further includes temperature sensor 54 for sensing temperature of water in the mixer nozzle. Temperature sensor 54 may, for example, be a thermistor molded into a housing that is mounted in the water stream. The time constant of the thermistor can be determined empirically. Temperature sensor 54 typically must meet UL requirement for 120 VAC isolation if system 50 does not include an isolation transformer.

Power is supplied to board 52 by power line L1. Board 52 generally operates from a power source of 120 VAC +10%, −15% 50/60 Hz. Board 52 also could be configured, for example, to operate on a 2-wire, 240 VAC +10%, −15%. Board 52 should not exceed a maximum input power of 500 milliwatts, at 120 VAC during operation, and less than 500 milliwatts in the standby or idle modes.

Other inputs to board 52 include an ATC signal, a PRE-TREATER signal, a C-IN signal, and a H-IN signal. The ATC signal is a 120 VAC signal that is active when the ATC control is selected, e.g., by toggling a toggle switch 53 on control panel 30, and the machine is filling. Rather than being positioned as shown in FIG. 2, switch 53 may be in series with thermistor 54. When switch 53 is located in this alternate position, and in an open condition, thermistor 54 will have a value which is outside a valid range and ATC control is not enabled. If switch 53 is closed and thermistor 54 is operating properly, then ATC control is enabled by toggling switch 53.

When ATC is active, system 50 operates to regulate the inlet water temperature by controlling the water valves to achieve the desired water temperature in the tub. The PRE-TREATER signal is a 120 VAC signal which indicates whether system 50 should activate the pre-treater cycle. System 50 is powered-up when the PRE-TREATER signal is active. The microcomputer pulls in relay K3, and pulling in relay K3 latches power to the system. Relay K1 is pulled in to activate the cold solenoid, and the system remains active for 7 seconds from the time that the PRE-TREATER signal was received.

The H-IN signal is a 120 VAC signal which indicates that either the hot water or warm water setting is selected. Warm is selected when both the H-IN and C-IN signals are present. The C-IN signal is a 120 VAC signal which indicates that either the cold water or warm water setting is selected. The H-IN and C-IN signals are supplied to logic board 52 from control panel 30.

The temperature sensor input is supplied from the temperature control thermistor for measuring the temperature of the water in the washing machine mixing nozzle. Particularly, the microprocessor on ATC board 52 includes an analog-to-digital converter, and the processor reads the signal from sensor 54. The magnitude of the signal is representative of the temperature in the mixing nozzle. Temperature sensor 54 is powered by a signal supplied from an output port of the microprocessor.

A signal indicative of whether the washing machine tub is full is supplied to board 52 by line FULL. The state of the signal on line FULL is indicative of the machine still filling. A water level sensor 56 in flow communication with the wash tub generates the signal.

A lid switch 58 also provides an input to board 52. Switch 58 indicates whether the wash machine lid is open (switch 58 is closed) or closed (switch 58 is open).

With respect to the outputs from logic board 52, the HOT water output is a feed through of the H-IN signal to the hot water valve. The COLD water output controls the cold water valve. Note that if the ATC signal is not active, then the C-IN signal will feed through to the cold control valve. When the ATC signal is active, then the processor interrupts the C-IN signal.

Generally, system 50 controls the temperature of the water in the washtub by regulating the inlet water flow between the hot and cold water valves. ATC board 52 is de-energized until the wash cycle is started and the machine is calling for water. On power-up, system 50 determines if the pre-treater or ATC function is selected. If the ATC function is selected, then the processor checks the C-IN signal and the H-IN signal to determine the desired water temperature range.

Set forth below in Table 2 are possible scenarios for the different selections.

TABLE 2

| | Control Scenario | | | | |
|---|---|---|---|---|---|
| | VALVES | | RELAYS | | |
| SELECTION | HOT | COLD | K1 | K2 | K3 |
| HOT WASH | ON | CYCLE | CYCLE | OFF | OFF |
| WARM WASH | ON | CYCLE | OFF | CYCLE | OFF |
| WARM RINSE | ON | CYCLE | OFF | CYCLE | OFF |
| COLD WASH | CYCLE | ON | ON | CYCLE | OFF |

The pre-treater function enables the operator to activate the cold water valve for a fixed duration of time while the lid is in the up position. When the pre-treater switch is pressed, relay K3 latches on the power for a period of 7 seconds. Relay K1 is then energized to power the cold water valve for 7 seconds. At the end of the 7 second period, relays K1 and K3 are de-energized to turn off the cold water valve and power down control 52.

The washing machine also includes a main motor having a motor start winding START as shown in FIG. 2. The main motor also includes a high speed run winding HIGH and a low speed run winding LOW. The HIGH winding is always in the circuit for motor starting but is switched off after starting if the slow speed is selected. The LOW winding is switched on by the motor centrifugal switch after starting. The START winding is turned off by the centrifugal switch after the motor starts. The direction in which the motor runs is controlled by switches S1 and S2. A speed select switch SPEED SEL SW controls the speed at which the motor operates. Switch S3 controls the motor speed during wash operations, and switch S4 controls the motor speed during spin operations.

The washing machine also includes a pump motor PUMP and timer motor TIMER. The pump motor PUMP discharges water from the machine. The timer motor TIMER drives the cam which actuates the switches, e.g., switches S5, S6, S7, S8, S9, S10, and S11.

Set forth below are flow charts describing process steps executed by the microprocessor on ATC board 52 in carrying out the various operations to provide ATC and pre-treater control. It should be understood, of course, that the present invention is not limited to the specific process steps and sequences set forth in the flow charts. In addition, the routines could be stored in a read only memory (ROM) associated with processor, or such routines could be implemented in the microprocessor firmware.

Figure 3:
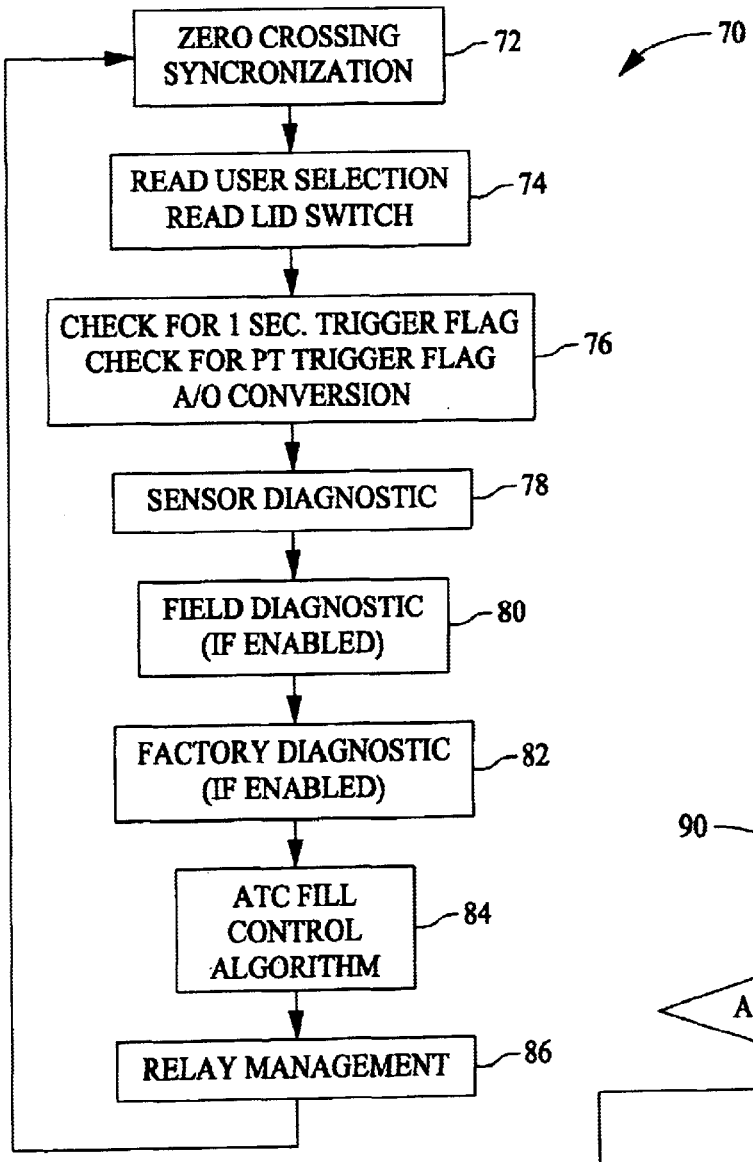
FIG. 3 is a flow chart illustrating process steps associated with the main module.

Specifically, FIG. 3 is a flow chart 70 illustrating process steps associated with a main execution module. As shown in FIG. 3, when executing the main module, the processor calls a zero crossing synchronization routine 72. The zero crossing routine is described below in detail in connection with FIG. 4. After executing the zero crossing routine, then the microprocessor reads 74 the user selections from control panel 30 and lid switch 58. The microprocessor then checks the status of a 1 second trigger flag and a phase time trigger flag 76. The 1 second trigger flag, as described below in more detail, is used in connection with updating the microprocessor timers. The microprocessor also reads the signal from the temperature sensor in the mixing nozzle, and the analog signal from the sensor is converted from an analog signal to a digital signal. A sensor diagnostic routine is then executed 78. The sensor diagnostic routine checks whether the value of thermistor 54 is out of a valid range. If the thermistor is not within the valid range, then ATC operations are suspended, i.e., a sensor error flag is set to on and relays K1, K2, and K3 are set to off, as described below in more detail in connection with FIG. 19. Also, and if enabled, field diagnostic 80 and factory diagnostic 82 routines are executed. These routines are described below in more detail in connection with FIGS. 17 and 18.

The ATC fill control algorithm is then executed 84 using the received inputs. The microprocessor then executes a relay management routine 86. Upon completion of the relay management routine processing returns to executing the zero crossing synchronization routine 72.

Figure 4:
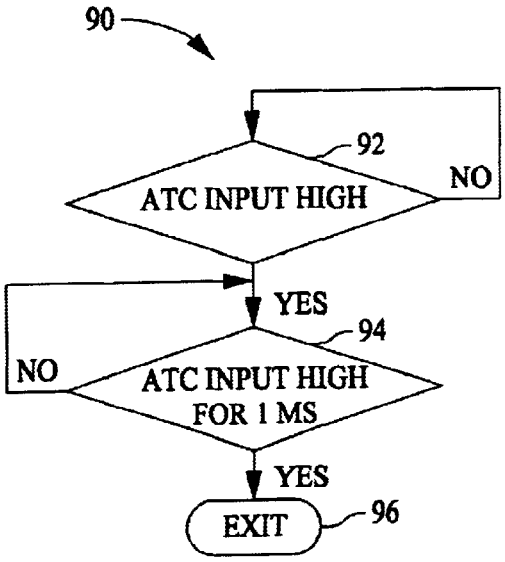
FIG. 4 is a flow chart illustrating process steps associated with the zero crossing module.

FIG. 4 is a flow chart 90 illustrating process steps associated with the zero crossing module. Particularly, the microprocessor checks whether the ATC input signal is "HIGH" 92. Such a HIGH state exists when an operator selects the ATC function on the control panel using, for example, a push button type switch. Once a HIGH state is detected, the microprocessor then checks whether the ATC input signal is in the HIGH state for at least 1 ms 94. This check is done for noise filtering. If the ATC input signal is in the HIGH state for at least 1 ms, then the routine is exited 96. As illustrated in FIG. 3, once the zero crossing synchronization module is exited, the microprocessor then proceeds in executing other process steps associated with ATC control.

Figure 5:
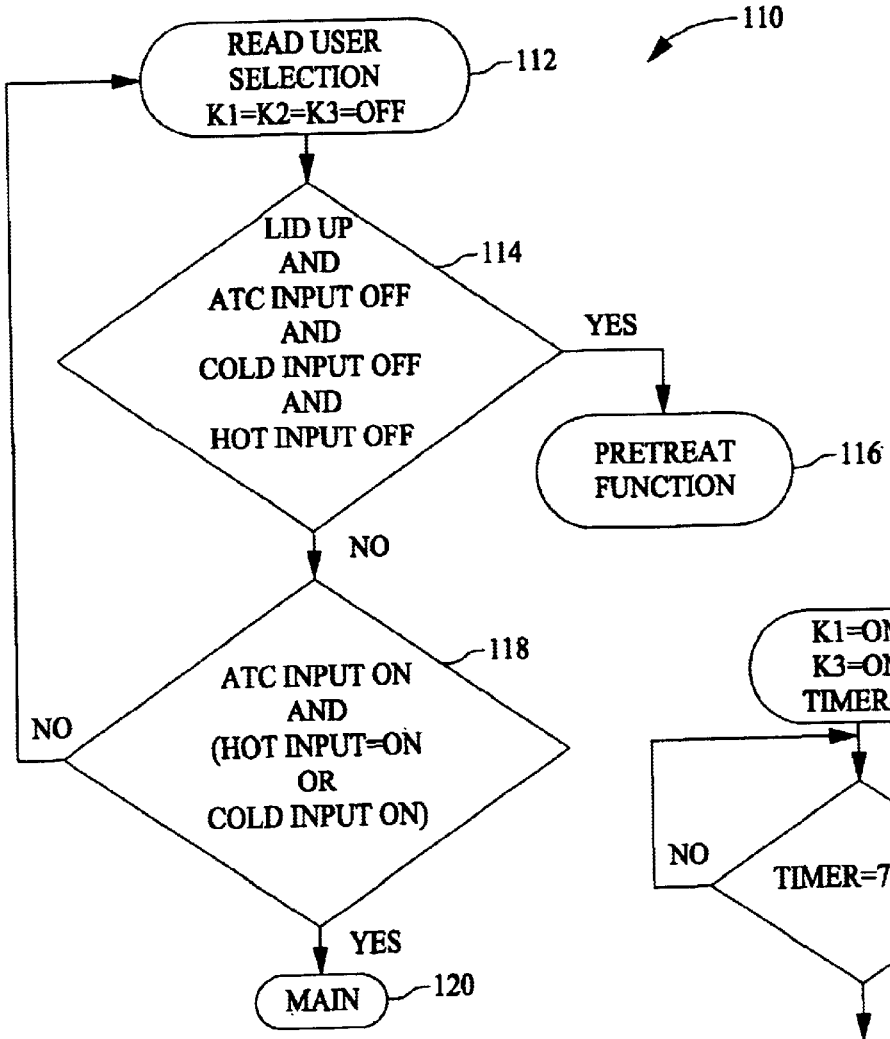
FIG. 5 is a flow chart illustrating process steps associated with the start module.

FIG. 5 is a flow chart 110 illustrating process steps associated with reading the user selections and the state of the lid switch (step 74 in FIG. 3), sometimes referred to herein as the start module. In executing the start module, the microprocessor reads the user selections from control panel 30, and sets relays K1, K2, and K3 to an OFF state 112. If the lid is up, the ATC input is off (or not active), and the hot and cold inputs are off 114, then the pre-treat function, or module, is executed 116. If these conditions are not satisfied, and if the ATC input is on and either the hot input or the cold input is on 118, then the processor calls the main module 120. Otherwise, processing returns to reading the user selections and setting relays K1, K2, and K3 to the OFF state 112.

Figure 6:
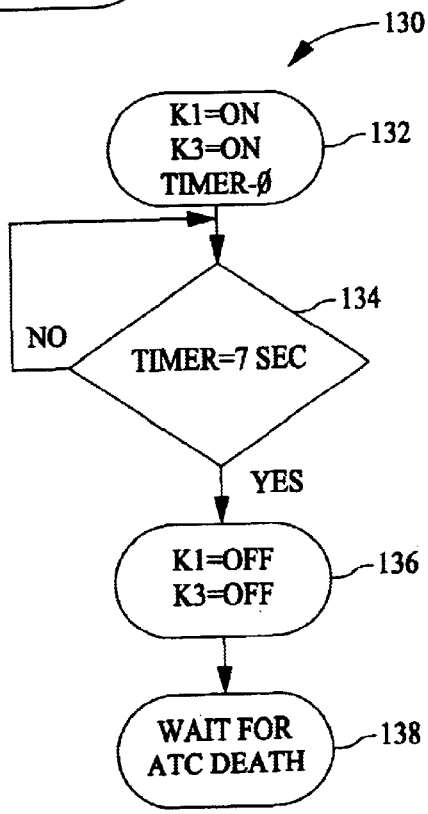
FIG. 6 is a flow chart illustrating process steps associated with the pre-treat module.

FIG. 6 is a flow chart 130 illustrating process steps associated with the pre-treat module. Once the pre-treat module is called, the microprocessor then sets relays K1 and K3 to the ON state and sets a timer equal to zero 132. Once the timer has counted 7 seconds 134, then microprocessor 54 sets relays K1 and K3 to the OFF state 136. Power is then removed from the ATC board 138.

Figure 7:
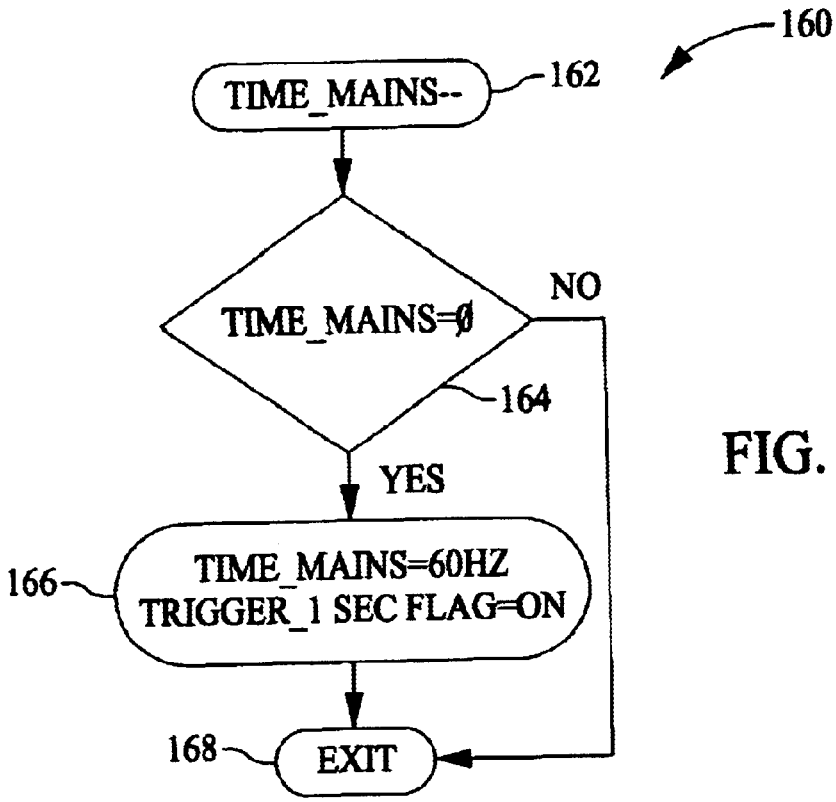
FIG. 7 is a flow chart illustrating process steps associated with the 1 second flag module.

FIG. 7 is a flow chart 160 illustrating process steps associated with the 1 second flag module. The module is utilized for setting timers and flags used in other modules. Particularly, when the TIME_MAINS module is called 162, TIME_MAINS is decremented and if the main timer goes to zero 164, then TIME_MAINS is set to equal 60 Hz and the TRIGGER_1 SEC FLAG is set to ON 166. The processor then exits the module 168. If the module is called and if TIME_MAINS does not go to zero 164, then the processor exits 168 the module without setting the flag.

Figure 8:
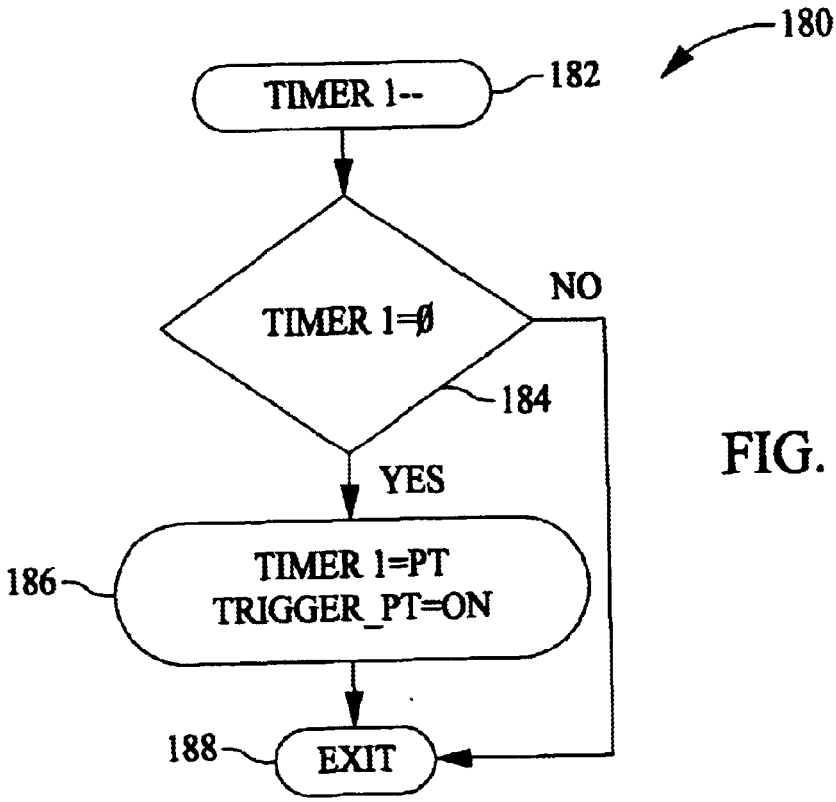
FIG. 8 is a flow chart illustrating process steps associated with the pre-treat flag module.

FIG. 8 is a flow chart 180 illustrating process steps associated with the PHASE TIME flag module. This module is used for setting the PHASE TIME flag. Particularly, when the TIMER 1 module is called 182, the phase time (PT) timer is decremented and if TIMER 1 goes to zero 184, TIMER 1 is set to equal phase time and the TRIGGER_PT is set to ON 186. The processor then exits the module. If the module is called and if TIMER 1 does not go to zero 184, processor 54 exits the module 188 without setting the flag.

Figure 9:
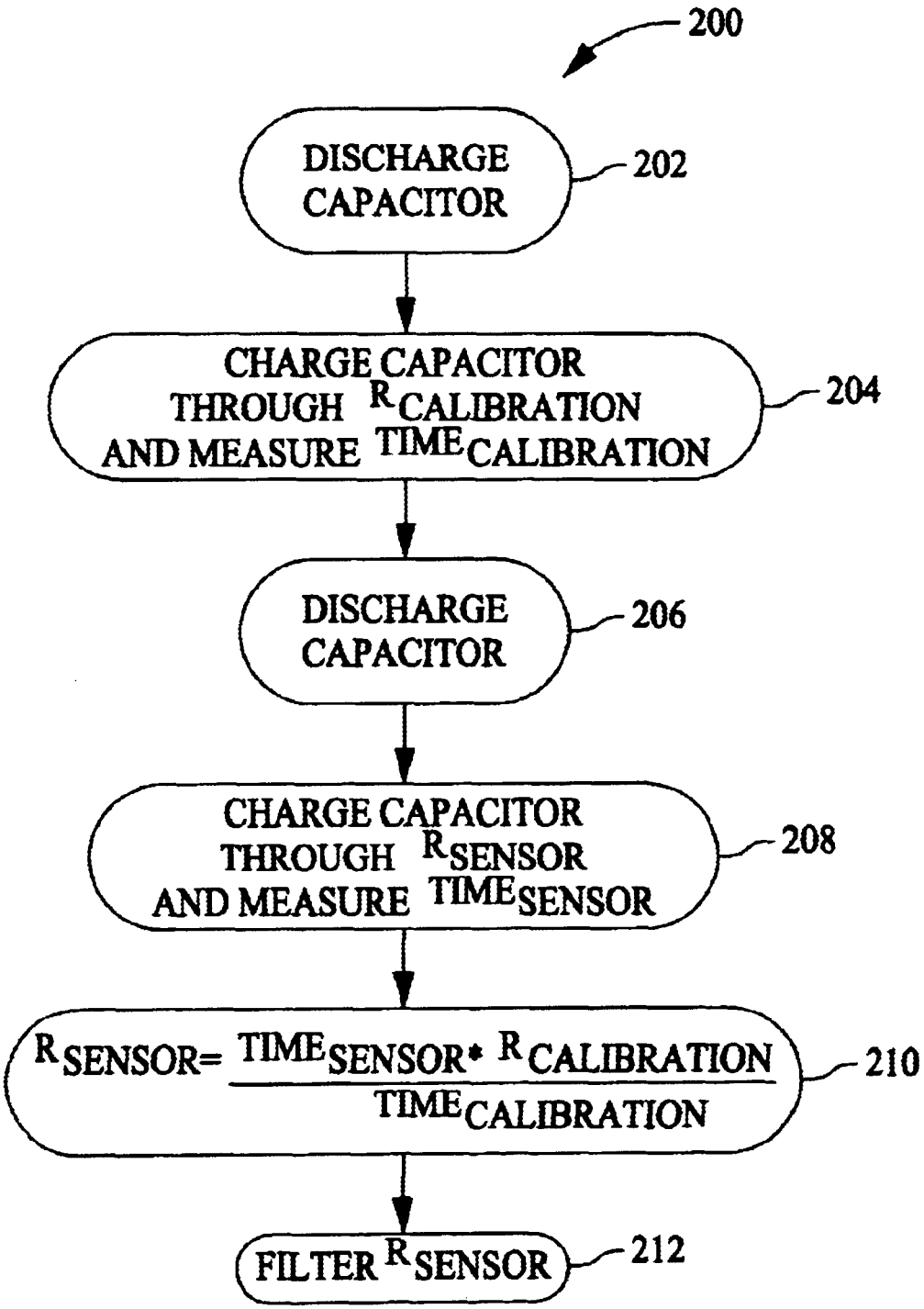
FIG. 9 is a flow chart illustrating process steps associated with the analog-to-digital converter module.

FIG. 9 is a flow chart 200 illustrating process steps associated with the analog-to-digital converter module. Generally, the processor controls the charging and discharging of a capacitor coupled to sensor 54, and measures the decay rate of the capacitor. The decay rate is a function of the temperature sensed by temperature sensor 54. More particularly, when the processor converts the analog temperature sensor signal to a digital signal, the processor causes the capacitor to discharge 202. Then, the processor enables the capacitor to be charged through a calibration resistor and the charge time is measured 204 by the processor. The processor then enables the capacitor to discharge 206 and to be charged through sensor 54. The charge time is measured 208 by the processor. The processor then determines the resistance at the sensor by multiplying the time to charge the capacitor through the sensor resistor by the magnitude of the calibration resistor, and then dividing the resulting value by the time to charge the capacitor through the calibration resistor 210. The determined resistance value of the sensor is then stored in memory. The above described process is then repeated multiple times, e.g., four times, to obtain four resistance values of the sensor. These values are then averaged to provide a filtered value for the resistance of the sensor 212. This resistance value is representative of the temperature of the water at sensor 54.

Figure 10:
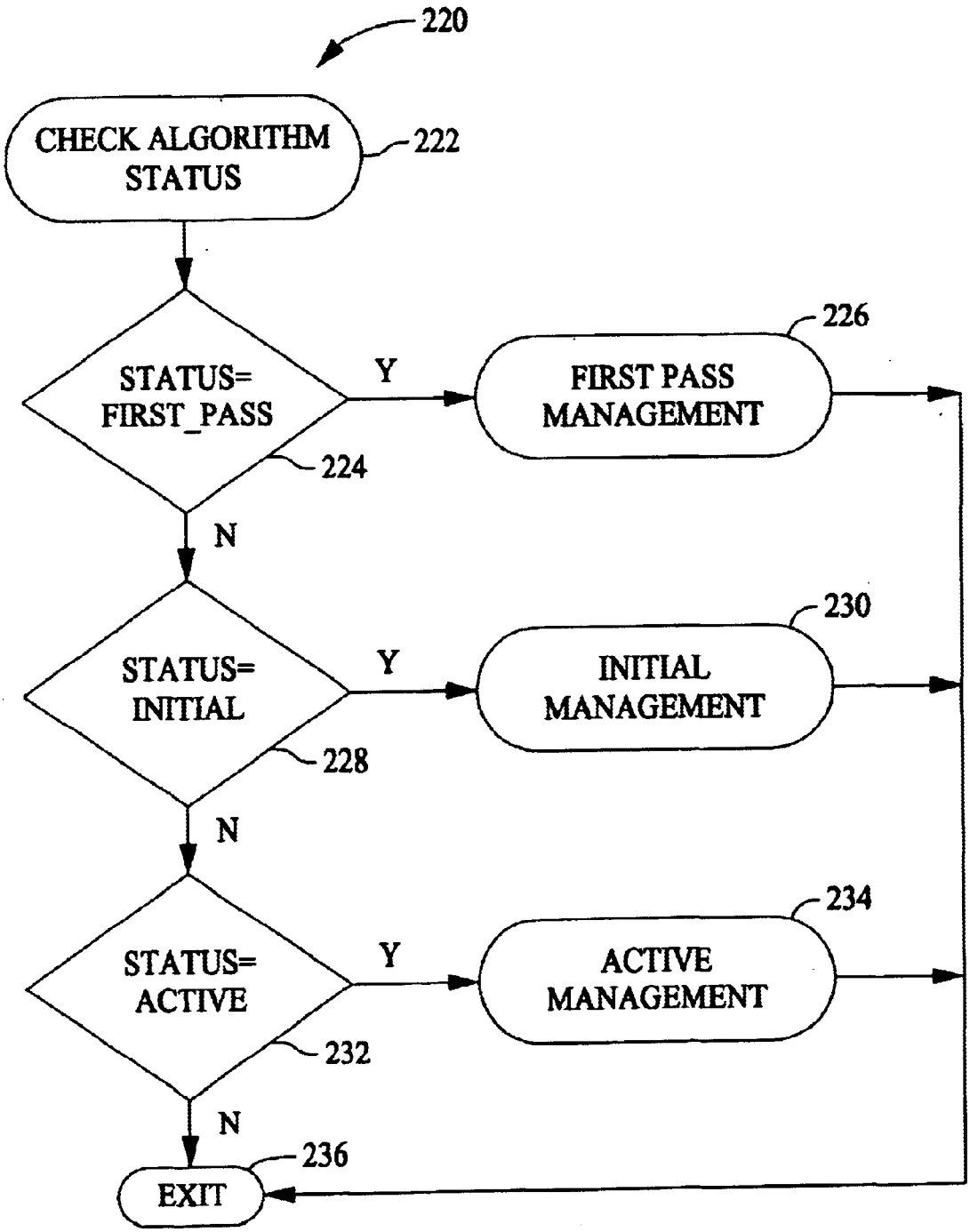
FIG. 10 is a flow chart illustrating process steps associated with the ATC fill control algorithm module.

FIG. 10 is a flow chart 220 illustrating process steps associated with the ATC fill control algorithm module. Generally, the processor checks the status of the algorithm 222. If it is the first pass 224 through the module, then a first pass management routine (e.g., initializing counters) is executed 226. If it is the initial complete pass through the module 228, then an initial management routine (e.g., for purging the lines of water and measuring the temperature of the water) is executed 230. If it is an active pass through the module 232, then an active management routine (e.g., for controlling cycling of the valves) is executed 234. The module is then exited after executing the appropriate routine 236.

Figure 11:
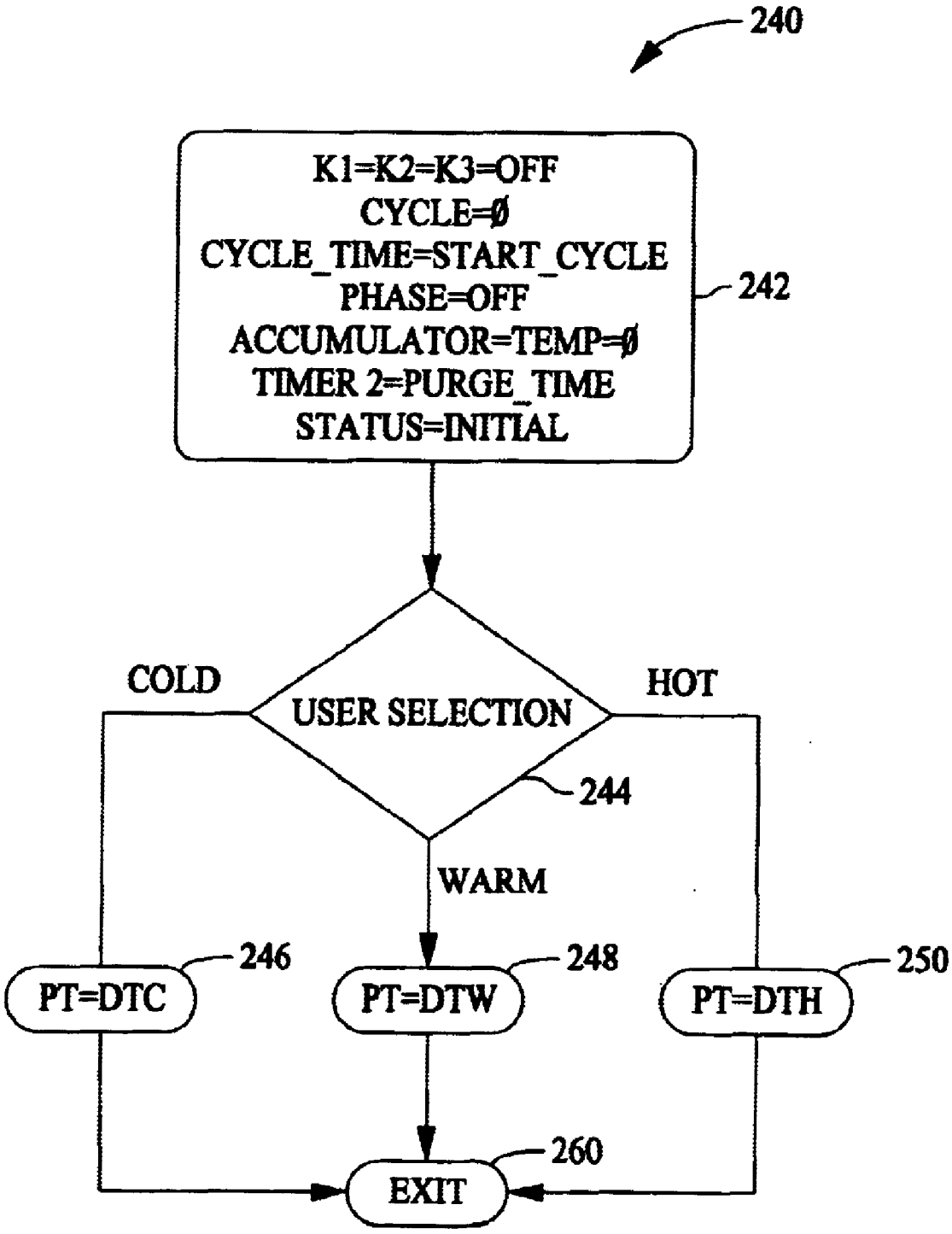
FIG. 11 is a flow chart illustrating process steps associated with the first pass management routine.

FIG. 11 is a flow chart 240 illustrating process steps associated with the first pass management routine. As shown in FIG. 11, relays K1, K2, and K3 are set to OFF, and the cycle timer is set to equal zero. The cycle time also is set to equal the start cycle, phase is set to OFF, and an accumulator is set to equal the temperature of the temperature sensor, which initially is zero. Also, timer 2 is set to equal the purge time, and the status is set to INITIAL 242. Then, based on the user selection of COLD, WARM, or HOT 244, the phase time flag is set to equal DTC 246, DTW 248, or DTH 250, respectively. DTC corresponds to a flow rate of 60% maximum, DTW corresponds to a flow rate of 100% maximum, and DTH corresponds to a flow rate of 40% maximum. The processor then exits the first pass management routine 260.

Figure 12:
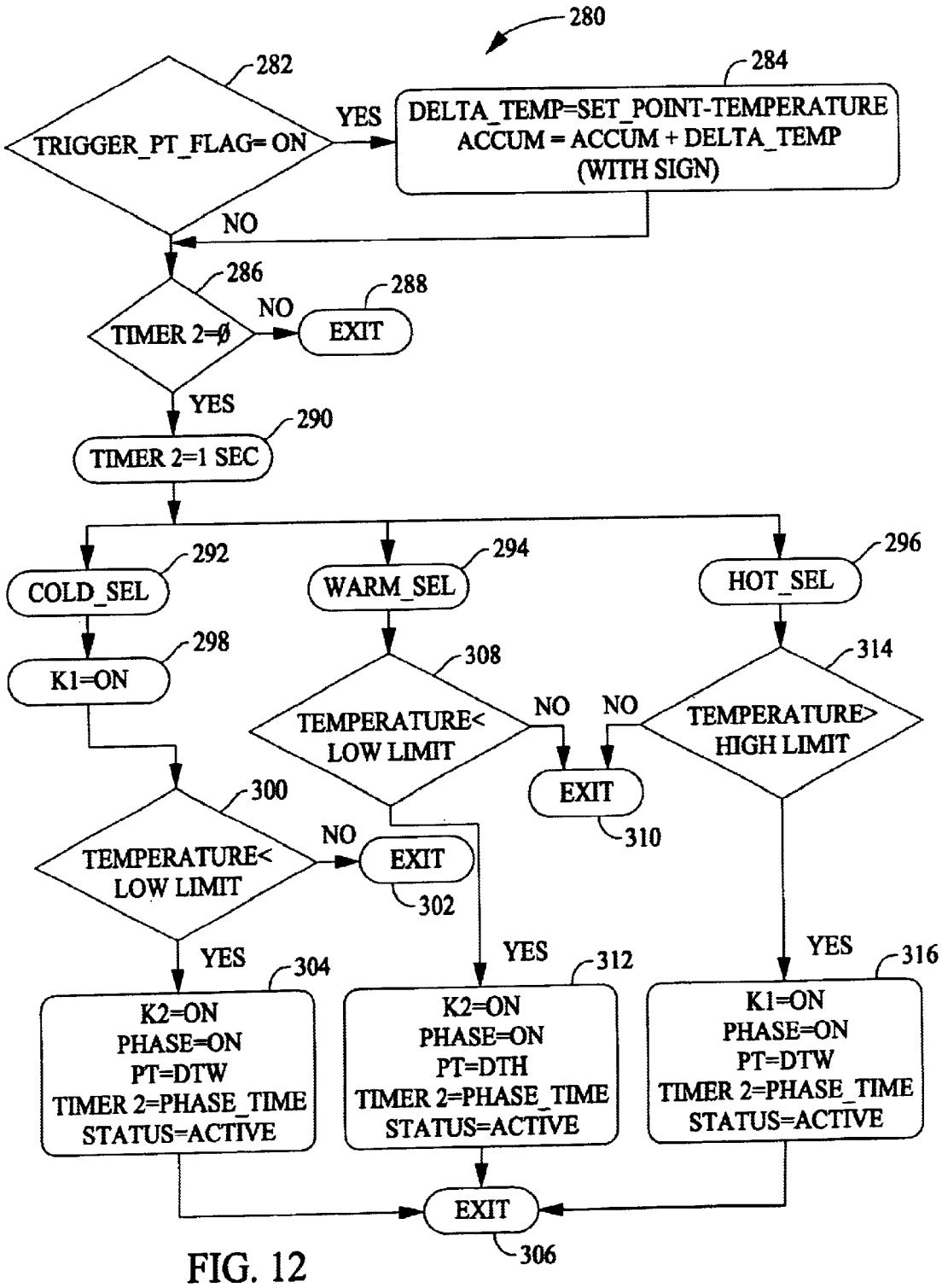
FIG. 12 is a flow chart illustrating process steps associated with the initial management routine.

FIG. 12 is a flow chart 280 illustrating process steps associated with the initial management routine. In this routine, the processor first checks the status of the phase time flag 282, and if the flag status in ON, then the temperature difference (DELTA_TEMP) is set to SET_POINT−TEMPERATURE (i.e., the temperature sensed by sensor 54), and the accumulator is increased by ACCUM=ACCUM+DELTA TEMP. If the PT flag is not ON, or after making the settings indicated at step 284, processing continues by determining whether TIMER 2 is equal to zero 286. If TIMER 2 is not equal to zero, then the routine is exited 288. If TIMER 2 is equal to zero, then TIMER 2 is set to equal 1 second 290. Processor 54 then continues by determining whether the COLD 292, WARM 294, or HOT 296 selections have been made at the control panel.

If COLD is selected 292, then relay K1 is set to ON 298, and if the measured temperature is not less than or equal to a preset LOW LIMIT 300, the routine is exited 302. If the measured temperature is less than the preset LOW LIMIT 300, processor sets relay K2 ON, phase is set ON, the PT flag is set to DTW, timer 2 is set to PHASE_TIME, and the STATUS is set to ACTIVE 304. The processor then exits the routine 306.

If WARM is selected 294, and if the measured temperature is not less than or equal to a preset LOW LIMIT 308, the routine is exited 310. If the measured temperature is less than the preset LOW LIMIT 308, the processor sets relay K2 ON, phase is set ON, the PT flag is set to DTH, timer 2 is set to PHASE_TIME, and the STATUS is set to ACTIVE 312. Processor 54 then exits the routine 306.

If HOT is selected 296, and if the measured temperature is not greater than or equal to a preset HIGH LIMIT 314, the routine is exited 310. If the measured temperature is greater than the preset HIGH LIMIT 314, the processor sets relay K1 ON, phase is set ON, the pre-treat flag is set to DTW, timer 2 is set to PHASE_TIME, and the STATUS is set to ACTIVE 316. The processor then exits the routine 306.

Figure 13A:
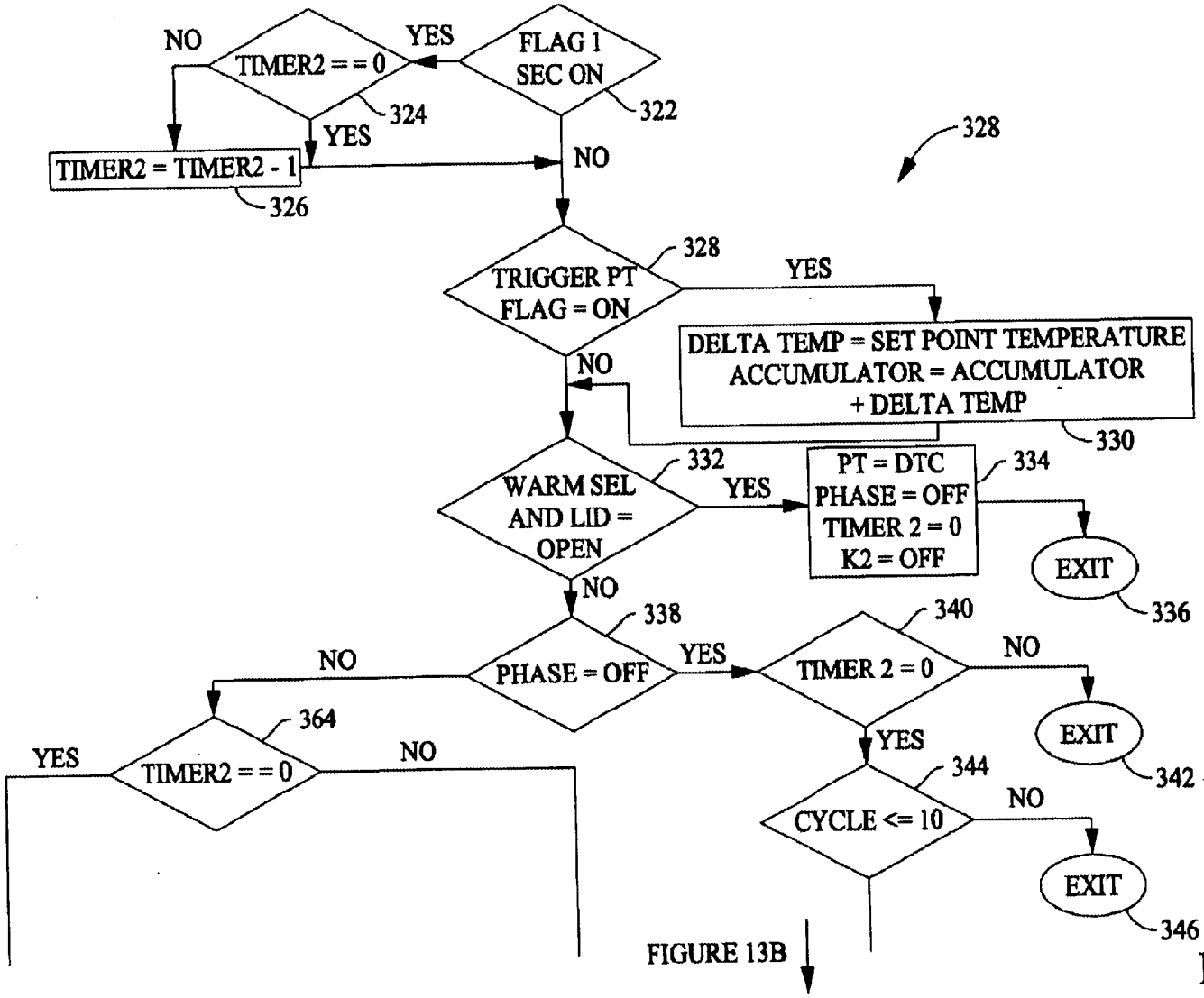
FIGS. 13A and 13B are a flow chart illustrating process steps associated with the active management routine.
Figure 13B:
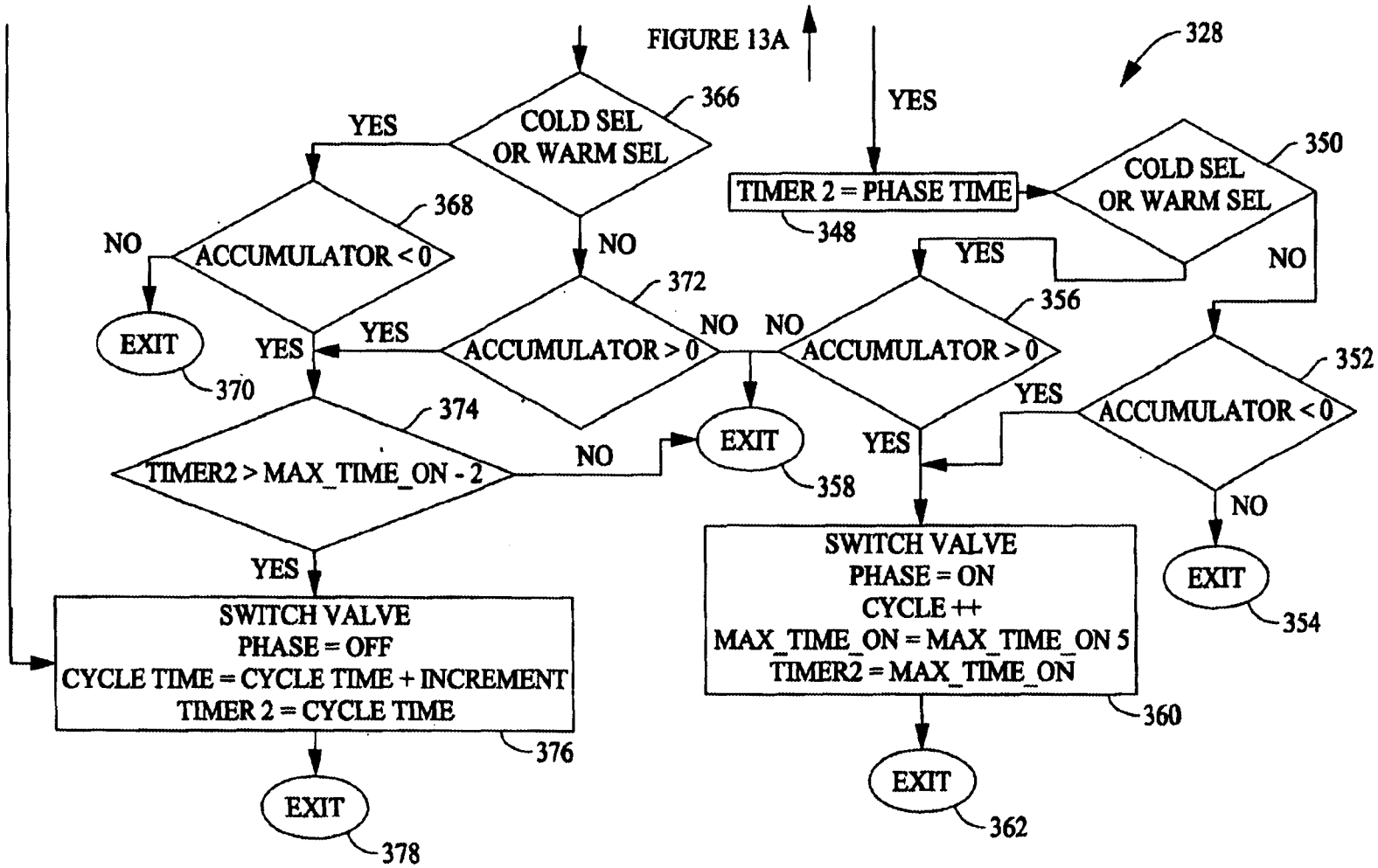

FIGS. 13A and 13B are a flow chart 320 illustrating process steps associated with the active management module. In this routine, the processor first checks the status of the 1 second flag 322. If the flag is on, then the processor checks whether TIMER 2 equals zero 324. If TIMER 2 does not equal zero, then TIMER 2 is decremented 326. After decrementing TIMER 2, or if the 1 second flag is not active, or if TIMER 2 is equal to zero, then processing proceeds to checking whether the phase time flag is active 328. If the phase time flag status is ON, then the temperature difference (DELTA_TEMP) is set to the SET_POINT TEMPERATURE minus the current temperature and DELTA_TEMP is added to the accumulator 330. If the PHASE TIME flag status is not ON, or after making the settings indicated at step 330, processing continues by determining whether WARM SEL is active and whether the lid is open 332. If WARM SEL is active and the lid is open, then the phase time is set to equal DTC, phase is set to off, TIMER 2 is set to zero, and relay K2 is set off 334. Routine 320 is then exited 336. Such control facilitates preventing a user from coming into direct contact with hot water flowing into the wash tub.

If WARM is not selected or if the lid is not open, then the processor 25 checks whether phase is set to OFF 338. If phase is set to OFF, and if TIMER 2 is not set to zero 340, then the processor exits the routine 342. If TIMER 2 is set to zero 340, and if the number of cycles is not less than or equal to a predetermined number of cycles (e.g., 10 cycles) 344, then the processor exits the routine 346. If the number of cycles is less than or equal to the predetermined number of cycles 344, then the processor sets TIMER 2 equal to PHASE_TIME 348. The processor then determines whether COLD or WARM has been selected 350. If COLD or WARM is not selected, and if the ACCUMULATOR value is greater than or equal to zero 352, then the routine is exited 354. If COLD or WARM is selected 350, and if the ACCUMULATOR value is greater than zero 356, then processing proceed to step 360. Processing also proceeds to step 360 if COLD or WARM are not selected 350 and the ACCUMULATOR value is less than zero 352. At step 360, the switch value routine is called, phase is set to on, cycle is set to cycle +1, MAX_TIME_ON is set to equal MAX_TIME_ON+5, and TIMER 2 is set to equal MAX_TIME_ON. Routine 320 is then exited 362.

At step 338, if phase is not set to OFF, then the processor determines whether TIMER 2 is equal to zero 364. If TIMER 2 is not equal to zero, the processor determines whether COLD or WARM has been selected 366. If COLD or WARM is selected, and if the accumulator value is greater than or equal to zero 368, then routine 320 is exited 370.

The following operations limit the time that hot water is provided to the tub. Limiting the time period for the flow of hot water to the tub enables better control of the temperature of the water in the tub. Particularly, and still referring to FIGS. 13A and 13B, if COLD or WARM is selected and if the accumulator value is not greater than zero 372, routine 320 is exited 358. If the accumulator value is less than zero 368 or greater than zero 372, then the processor determines 374 whether TIMER 2 is greater than MAX_TIME_ON−2. If no, then routine 320 is exited. If yes, then the SWITCH VALVE routine is called, phase is set to off, cycle time is set to cycle time+increment cycle time value (5 sec.) and TIMER 2 is set to equal cycle time 376. Step 376 also is executed if at step 364, processor determines that Timer 2 is equal to zero. After executing step 376, the processor exits the routine 378.

Figure 14:
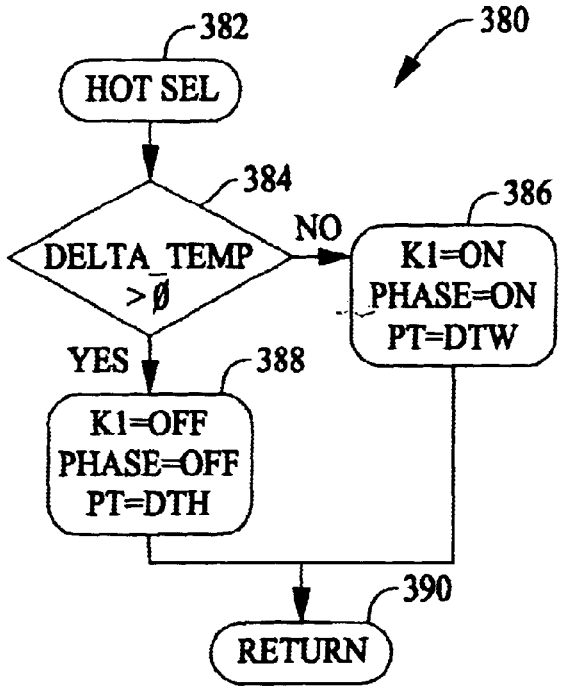
FIG. 14 is a flow chart illustrating process steps associated with the hot select module.

FIG. 14 is a flow chart 360 illustrating process steps associated with the hot select module. Once the hot selection module is called 362, processor 54 checks whether DELTA_TEMP is greater than zero 364. If DELTA_TEMP is not greater than or equal to zero, then processor 54 sets K1 to ON, PHASE to ON, and PT equal to DTW 386. If DELTA_TEMP is greater than zero 384, then processor 54 sets K1 to OFF, PHASE to OFF, and PT equal to DTH 388. Processor 54 then exits the routine 390.

Figure 15:
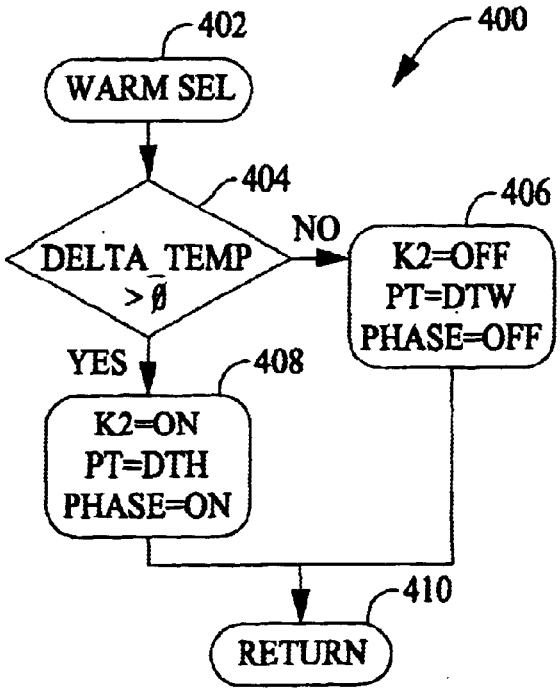
FIG. 15 is a flow chart illustrating process steps associated with the warm select module.

FIG. 15 is a flow chart 400 illustrating process steps associated with the warm select module. Once the warm selection module is called 402, processor 54 checks whether DELTA_TEMP is greater than zero 404. If DELTA_TEMP is not greater than or equal to zero, then processor 54 sets K2 to OFF, PHASE to OFF, and PT equal to DTW 406. If DETLA_TEMP is greater than zero, then processor 54 sets K1 to ON, PHASE to ON, and PT equal to DTH 408. Processor 54 then exits the routine 410.

Figure 16:
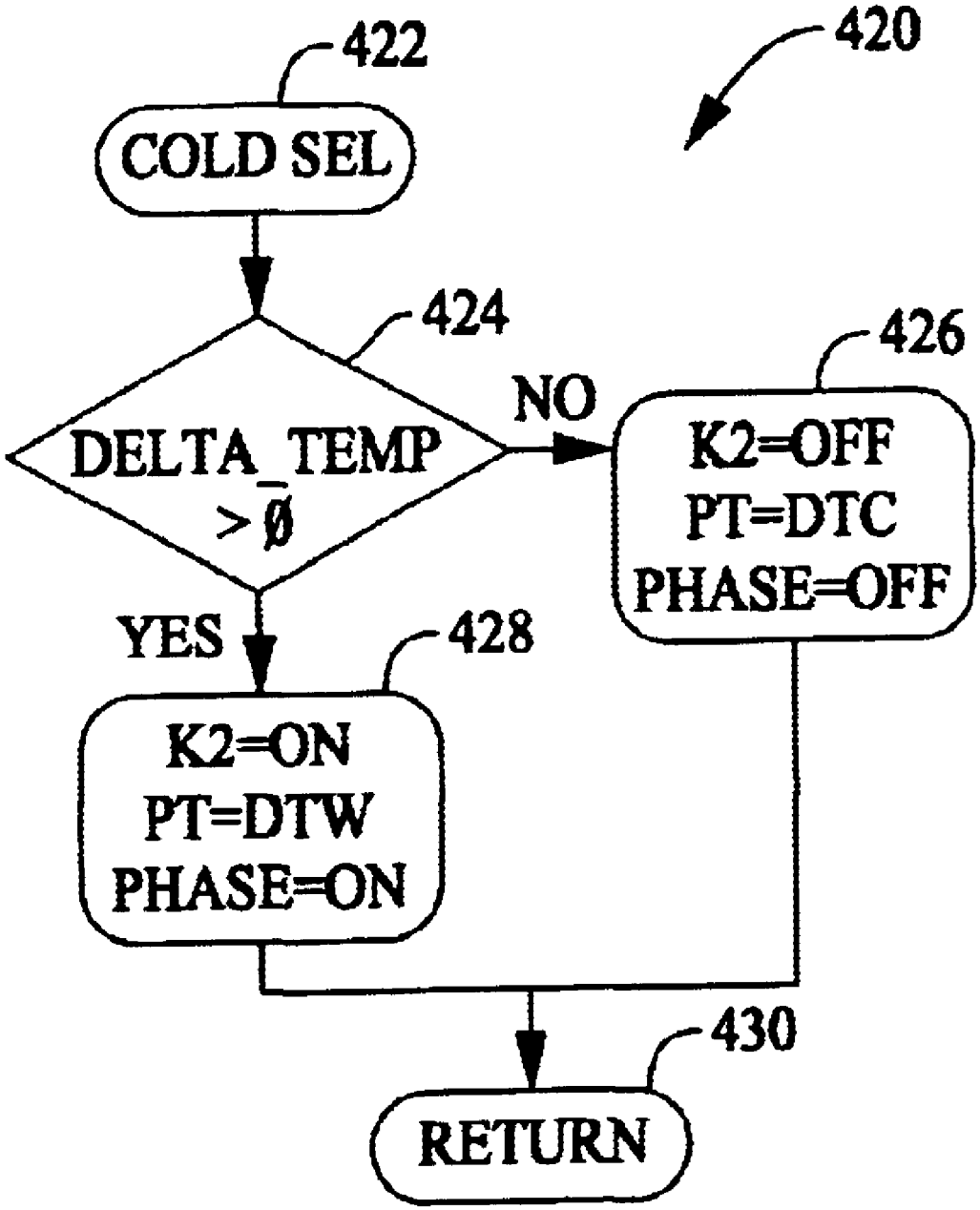
FIG. 16 is a flow chart illustrating process steps associated with the cold select module.

FIG. 16 is a flow chart 420 illustrating process steps associated with the cold select module. Once the cold selection module is called 422, processor 54 checks whether DELTA_TEMP is greater than zero 424. If DELTA_TEMP is not greater than or equal to zero, then processor 54 sets K2 to OFF, PT equal to DTC, and PHASE to OFF 426. If DETLA_TEMP is greater than zero, then processor 54 sets K2 to ON, PT equal to DTW, and PHASE to ON 428. Processor 54 then exits the routine 430.

The following values can be used for the variables referenced in the control algorithm described above.

HOT SEL: SET POINT=130° F.
  HOT HIGH LIMIT TEMPERATURE=135° F.
WARM SEL: SET POINT=95° F.
  WARM LOW LIMIT TEMPERATURE=85° F.
COLD SEL: SET POINT=70° F.
  COLD LOW LIMIT TEMPERATURE 65° F.
    TIMING
      DTW=1 SEC
      DTC=1 SEC
      DTH=2 SEC
      PURGE_TIME=30 SEC
      PHASE_TIME=20 SEC
      INCREMENT_CYCLE_TIME=5 SEC

Figure 17:
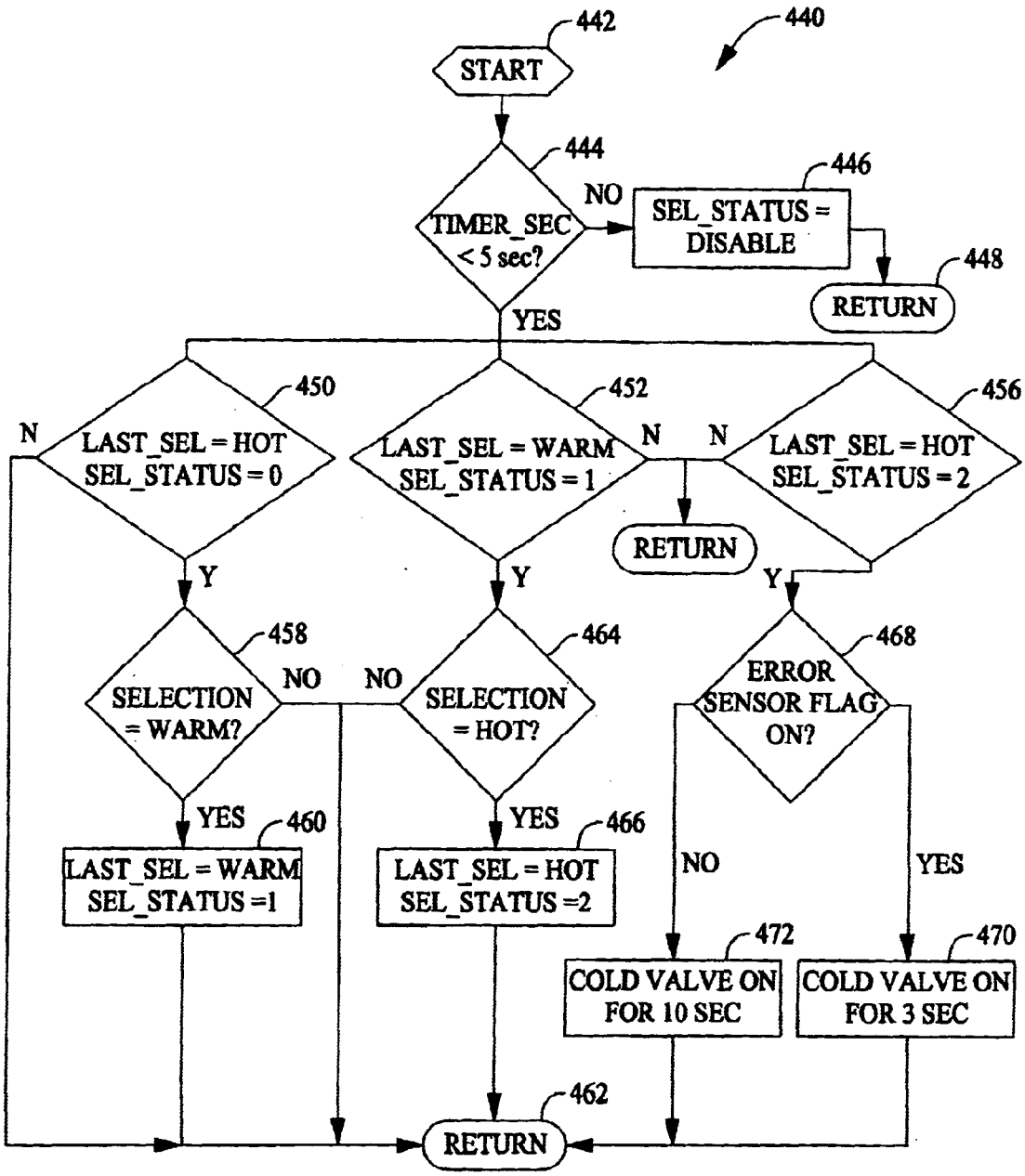
FIG. 17 is a flow chart illustrating process steps associated with the field test routine.

FIG. 17 is a flow chart illustrating process steps associated with a field test, or diagnostic, routine 440 referenced at step 80 in FIG. 3. Once called, or started, 442, the processor checks whether TIMER_SEC is less than 5 seconds 444. If the value of TIMER_SEC is not less than 5 seconds, then SEL_STATUS is disabled 446 and processing returns to the main routine 448. If TIMER_SEC is less than 5 seconds, then the processor determines whether LAST_SEL equals hot and SEL_STATUS equals zero 450, LAST_SEL equals warm and SEL_STATUS equals one 452, or LAST_SEL equals hot and SEL_STATUS equals 2 456. If none of these conditions are met, processing returns to the main routine. If LAST_SEL equals hot and SEL_STATUS equals zero 450, then the processor determines if SELECTION equals warm 458. If SELECTION equals warm, then LAST_SEL is set to equal warm and SEL_STATUS is set to equal one 460, and processing returns to the main routine 462. If SELECTION is not equal to warm, then processing returns directly to the main routine 462.

If LAST_SEL equals warm and SEL_STATUS equals 1 452, then the processor determines if SELECTION equals hot 464. If SELECTION equals hot, then LAST_SEL is set to equal hot and SEL_STATUS is set to equal 2 466, and processing returns to the main routine 462. If SELECTION does not equal hot, then processing returns directly to the main routine 462.

If LAST_SEL equals hot and SEL_STATUS equals 2 456, then the processor checks whether an error sensor flag is on 468. If an error sensor flag is on, then the cold valve is cycled on for 3 seconds 470. If an error sensor flag is not on, then the cold valve is cycled on for 10 seconds 472. Processing then returns to the main routine 462.

To perform the field test, and in accordance with the routines described in connection with FIGS. 17 and 20, the technician selects Hot fill water from the selector switch. Then, the technician selects Wash on the timer and pulls the timer knob to start the washer. Within three seconds, the technician switches the water temperature select to Warm and back to Hot. If the board is good, the Cold valve is switched ON by the control within 4 to 5 seconds. Then, if the control senses a good sensor, the Cold valve will remain ON for 10 seconds. Or, if the control senses a bad sensor, the COLD valve will switch to OFF after three seconds.

Figure 18:
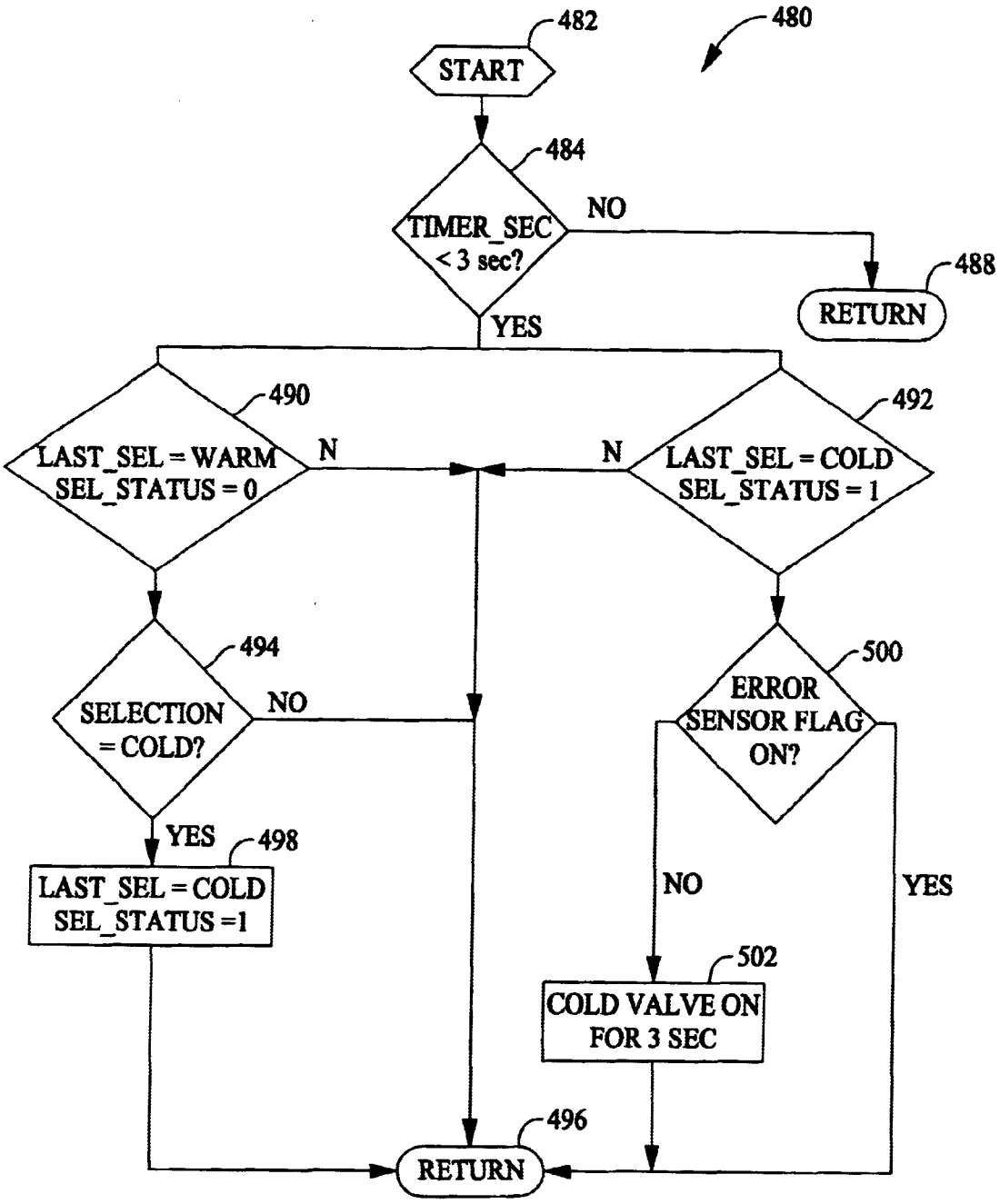
FIG. 18 is a flow chart illustrating process steps associated with the factory test routine.

FIG. 18 is a flow chart illustrating process steps associated with a factory test, or diagnostic, routine 480 referenced at step 82 in FIG. 3. After starting 482 the routine, the processor checks whether TIMER_SEC has a value less than 3 seconds 484. If no, processing returns to the main routine 488. If yes, then the processor checks whether LAST_SEL equals warm and SEL_STATUS equals zero 490, or if LAST_SEL equals cold and SEL_STATUS equals 1 492. If none of these conditions are met, then processing returns to the main routine. If LAST_SEL equals warm and SEL_STATUS equals zero 490, then the processor checks whether SELECTION equals cold 494. If no, then processing returns to the main routine 496. If yes, then LAST_SEL is set to equal cold and SEL_STATUS is set to equal one 498.

If LAST_SEL equals cold and SEL_STATUS equals one 492, then the processor checks whether the error sensor flag is on 500. If yes, then processing returns to the main routine 496. If no, then the cold valve is cycled on for 3 seconds 502. Processing then returns to the main routine 496.

To perform the factory test, and in accordance with the routines described in connection with FIGS. 18 and 20, the technician selects Warm fill water from the selector switch. Then, the technician selects Wash on the timer and pulls the timer knob to start the washer. Within fifteen seconds, with the lid up, the technician switches the water temperature select to Cold. The Hot valve will turn OFF when Cold is selected. After a two second delay, the Hot valve will switch back ON for three seconds if lid-up is sensed and the board and sensor are good.

Figure 19:
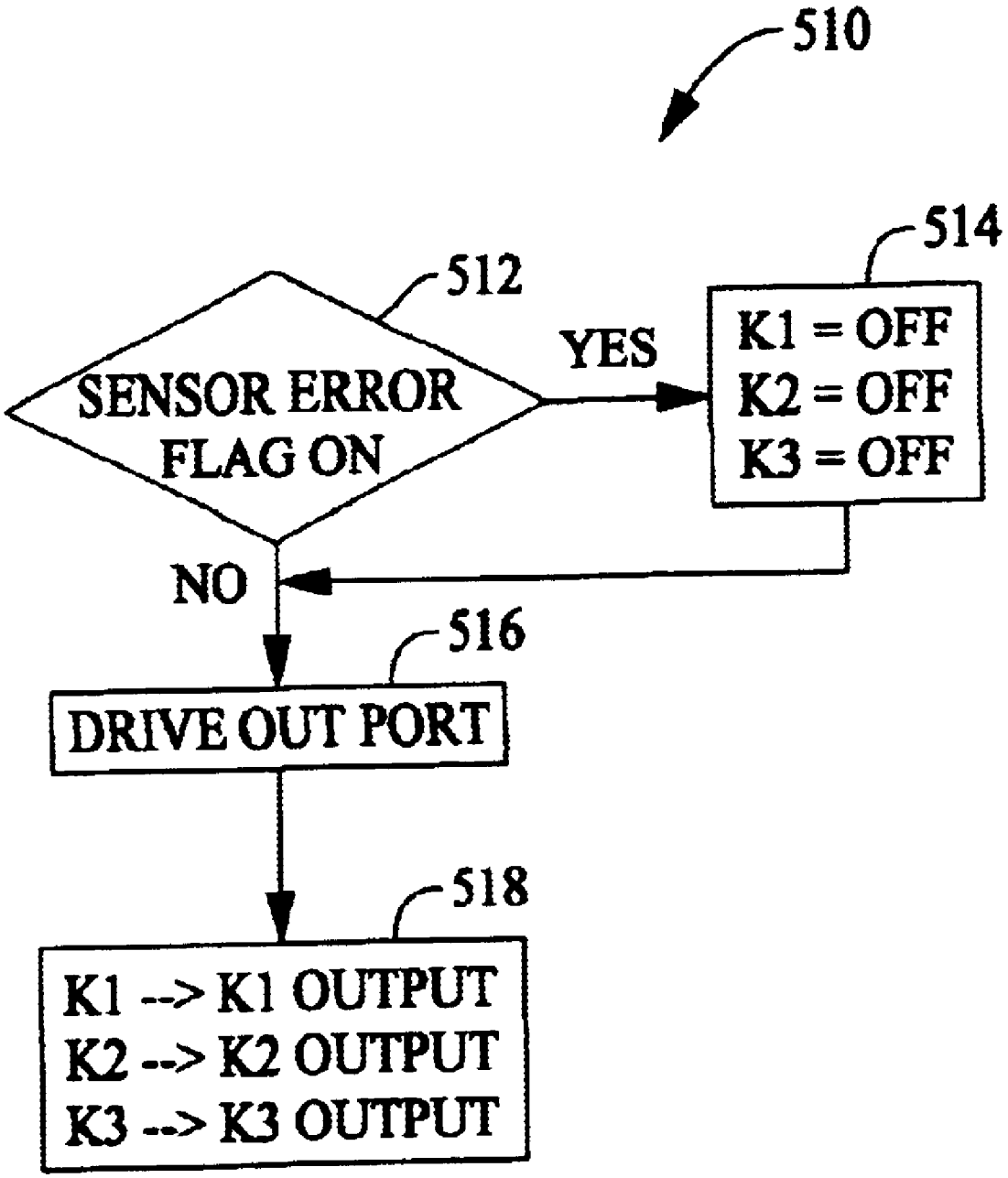
FIG. 19 is a flow chart illustrating process steps associated with relay management.

FIG. 19 is a flow chart illustrating process steps associated with a relay management routine 510 referenced at step 80 in FIG. 3. Once called, the processor checks whether the sensor error flag is on 512, and if the error flag is on, then relays K1, K2, and K3 are set to off. If the error flag is not on, or after setting relays K1, K2, and K3 off, then the processor drives the out port 516. Relays K1, K2, and K3 are then set to K1 output, K2 output, and K3 output.

Figure 20:
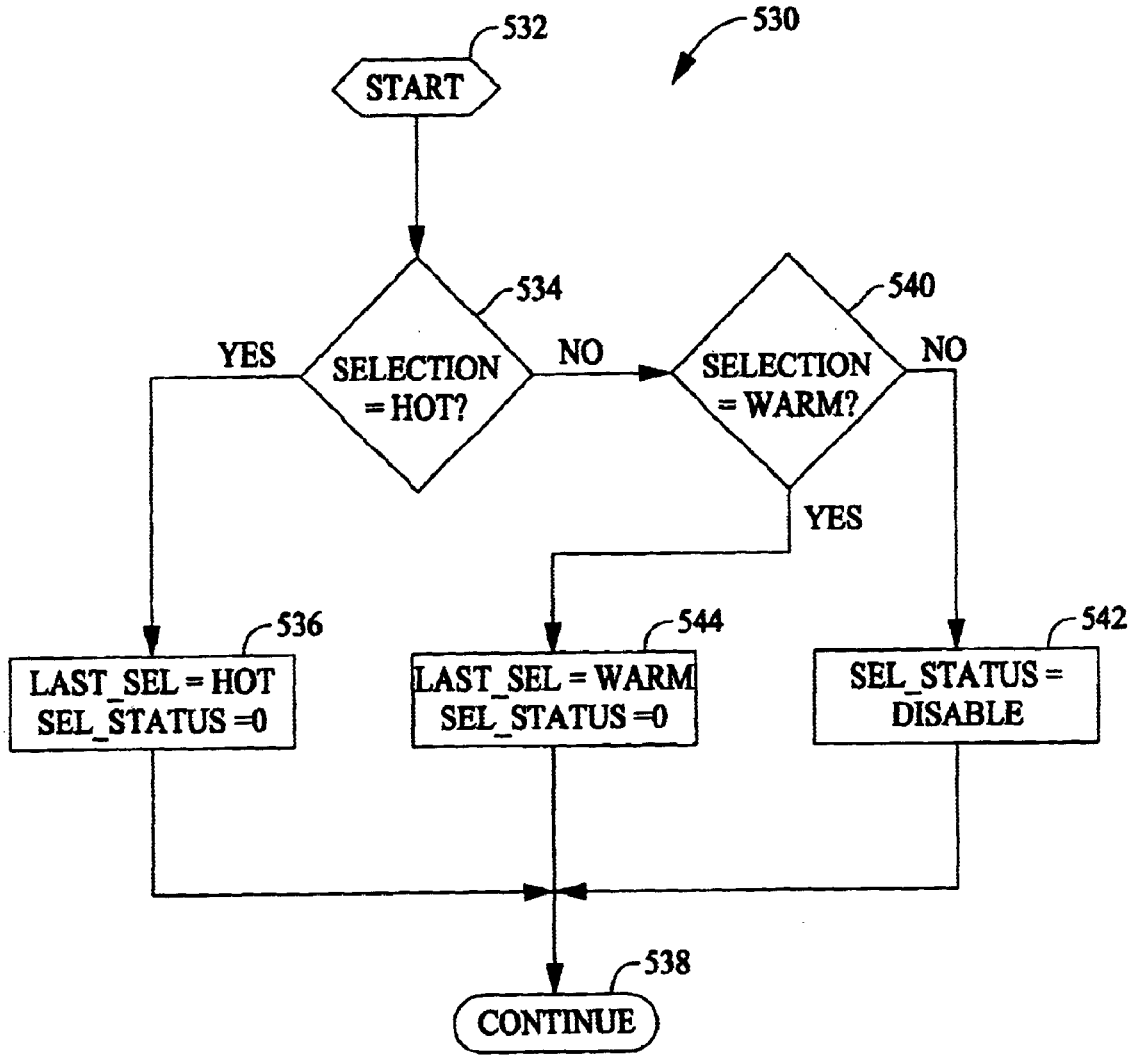
FIG. 20 is a flow chart illustrating process steps associated with status initialization.

FIG. 20 is a flow chart illustrating process steps associated with status initialization routine 530. Upon power up of the ATC board 532, the processor checks to determine whether SELECTION equals hot 534. If SELECTION equals hot, then processor sets LAST_SEL equal to hot and SEL_STATUS equal to zero 536, and processing continues with the main routine 538. If SELECTION is not equal to hot, then the processor checks whether SELECTION equals warm 540. If SELECTION is not equal to warm, then SEL_STATUS is set to disable 542 and processing continues with the main routine 538. If SELECTION is equal to warm, then the processor sets LAST_SEL equal to warm and SEL_STATUS equal to zero, and processing continues with the main routine 538.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An automatic temperature control system for a washing machine including a mixing nozzle in flow communication with a wash tub, a hot water conduit and a cold water conduit in flow communication with the-mixing nozzle, a cold water valve controlling flow of water from the cold water conduit to the mixing valve, and a hot water valve for controlling flow of hot water from the hot water conduit to the mixing valve, said system comprising:

a microprocessor;

a temperature sensor configured to sense the temperature of water supplied to the wash tub and electrically coupled to said microprocessor;

a cold water relay configured to be coupled to the cold water valve, said cold water relay electrically coupled to said microprocessor;

a hot water relay configured to be coupled to the hot water valve, said hot water relay electrically coupled to said microprocessor;

said microprocessor programmed to control operation of said cold water relay and said hot water relay so that a desired water temperature is provided in the mixing nozzle, said microprocessor further programmed to perform a pretreater function.

2. An automatic temperature control system in accordance with claim 1 wherein the washing machine further includes a lid and a pretreater selection control mounted on the control panel, and wherein said microprocessor is programmed to execute a pretreater routine if an operator activates the pretreater selection control and if the lid is open.

3. An automatic temperature control system in accordance with claim 1 wherein said pretreater function comprises opening the cold water valve for a predetermined period of time to allow cold water to flow to the mixing nozzle.

4. A washing machine comprising:

a wash tub;

a mixing nozzle in flow communication with said tub;

a hot water conduit in flow communication with said mixing nozzle;

a cold water conduit in flow communication with said mixing nozzle;

a cold water valve controlling flow of water from said cold water conduit to said mixing valve;

a hot water valve for controlling flow of hot water from said hot water conduit to said mixing valve; and an automatic temperature control system comprising a microprocessor, a temperature sensor configured to be located in said mixing nozzle and electrically coupled to said microprocessor, a cold water relay configured to be coupled to the cold water valve, said cold water relay electrically coupled to said microprocessor, a hot water relay configured to be coupled to the hot water valve, said hot water relay electrically coupled to said microprocessor, said microprocessor programmed to control operation of said cold water relay and said hot water relay so that a desired water temperature is provided in the mixing nozzle, said microprocessor further programmed to perform a pretreater function.

5. A washing machine in accordance with claim 4 further comprising a lid and a control panel, a pretreater selection control mounted on said control panel, said microprocessor programmed to execute a pretreater routine if said pretreater function is selected by an operator and if said lid is open.

6. A washing machine in accordance with claim 4 wherein said pretreater function comprises opening said cold water valve for a predetermined period of time to allow cold water to flow to said mixing nozzle.

7. A method for controlling a flow of hot and cold water to a wash tub in a washing machine during a fill operation, the washing machine including a mixing nozzle, a hot water conduit and a cold water conduit in flow communication with the mixing nozzle, a cold water valve controlling flow of hot water from the cold water conduit to the mixing valve, and a hot water valve for controlling flow of hot water from the hot water conduit to the mixing valve, the washing machine further including a control panel having a pretreater switch mounted thereto, said method comprising the steps of:

determining a temperature of the water flowing to the tub;

if the water temperature is not within a desired range, then cycling at least one of the hot water valve and the cold water valve;

if an operator selects the pretreater switch, then performing a pretreater operation.

8. A method in accordance with claim 7 wherein the washing machine further includes a lid, and wherein the pretreater step is performed only if the lid is open.

9. A method in accordance with claim 7 wherein performing the pretreater operation comprises the step of allowing cold water to flow to the mixing nozzle.

10. A pretreater control system for a washing machine including a mixing nozzle in flow communication with a wash tub, a cold water conduit in flow communication with the mixing nozzle, a cold water valve controlling flow of water from the cold water conduit to the mixing valve, and a pretreater selection control actuatable by an operator, said system comprising:

a microprocessor;

a cold water relay configured to be coupled to the cold water valve, said cold water relay electrically coupled to said microprocessor;

said microprocessor programmed to execute a pretreater control routine upon actuation of the pretreater selection control.

11. A pretreater control system in accordance with claim 10 wherein the washing machine further includes a lid, and wherein said microprocessor is programmed to execute the pretreater routine if an,operator activates the pretreater control and if the lid is open.

12. A pretreater control system in accordance with claim 10 wherein said pretreater function comprises opening the cold water valve for a predetermined period of time to allow cold water to flow to the mixing nozzle.

13. A pretreater control system in accordance with claim 10 wherein said predetermined period of time equals 7 seconds.

14. An automatic temperature control system for a washing machine including a mixing nozzle in flow communication with a wash tub, a hot water conduit and a cold water conduit in flow communication with the mixing nozzle, a cold water valve controlling flow of water from the cold water conduit to the mixing valve, and a hot water valve for controlling flow of hot water from the hot water conduit to the mixing valve, said system comprising:

a microprocessor;

a temperature sensor configured to sense the temperature of water supplied to the wash tub and electrically coupled to said microprocessor;

a cold water relay configured to be coupled to the cold water valve, said cold water relay electrically coupled to said microprocessor;

a hot water relay configured to be coupled to the hot water valve, said hot water relay electrically coupled to said microprocessor;

said microprocessor programmed to control operation of said cold water relay and said hot water relay so that a desired water temperature is provided in the mixing nozzle and said microprocessor configured to integrate the water temperature sensed by said temperature sensor to predict a length of a time period required for a subsequent water valve cycle.

15. A washing machine comprising:

a wash tub;

a mixing nozzle in flow communication with said tub;

a hot water conduit in flow communication with said mixing nozzle;

a cold water conduit in flow communication with said mixing nozzle;

a cold water valve controlling flow of water from said cold water conduit to said mixing valve;

a hot water valve for controlling flow of hot water from said hot water conduit to said mixing valve; and an automatic temperature control system comprising a microprocessor, a temperature sensor configured to be located in said mixing nozzle and electrically coupled to said microprocessor, a cold water relay configured to be coupled to the cold water valve, said cold water relay electrically coupled to said microprocessor, a hot water relay configured to be coupled to the :hot water valve, said hot water relay electrically coupled to said microprocessor, said microprocessor programmed to control operation of said cold water relay and said hot water relay so that a desired water temperature is provided in the mixing nozzle, said microprocessor configured to integrate a water temperature sensed by said temperature sensor to predict a length of a time period required for a subsequent water valve cycle.

16. A method for controlling a flow of hot and cold water to a wash tub in a washing machine during a fill operation, the washing machine including a mixing nozzle, a hot water conduit and a cold water conduit in flow communication with the mixing nozzle, a cold water valve controlling flow of water from the cold water conduit to the mixing valve, and a hot water valve for controlling flow of hot water from the hot water conduit to the mixing valve, said method comprising the steps of:

reading a temperature sensor located in the mixing valve;

if the water temperature is not within a desired range, then cycling at least one of the hot water valve and the cold water valve; and integrating the water temperature sensed by the temperature sensor to predict a length of a time period required for a subsequent water valve cycle.

* * * * *

UNITED STATES PATENT AND TRADEMARK OFFICE

CERTIFICATE OF CORRECTION

PATENT NO. : 6,634,048 B1
DATED : October 21, 2003
INVENTOR(S) : Hornung et al.

It is certified that error appears in the above-identified patent and that said Letters Patent is hereby corrected as shown below:

Column 13,
Line 39, delete “the-mixing” and insert therefor -- the mixing --.

Column 14,
Line 42, delete “of hot water from” and insert therefor -- of water from --.

Column 15,
Line 11, delete “an,operator” and insert therefor -- an operator --.

Signed and Sealed this

Sixth Day of April, 2004

JON W. DUDAS
*Acting Director of the United States Patent and Trademark Office*